United States Patent [19]

Inoue et al.

[11] Patent Number: 4,925,777

[45] Date of Patent: May 15, 1990

[54] DIRECT POSITIVE COLOR IMAGE FORMING METHOD

[75] Inventors: Noriyuki Inoue; Takashi Ozawa, both of Kanagawa, Japan

[73] Assignee: Fuji Photo Film Co., Ltd., Kanagawa, Japan

[21] Appl. No.: 260,081

[22] Filed: Oct. 20, 1988

[30] Foreign Application Priority Data

Oct. 20, 1987 [JP] Japan ..... 62-264340

[51] Int. Cl.[5] ..... G03C 7/30; G03C 1/22; G03C 1/485

[52] U.S. Cl. ..... 430/377; 430/378; 430/409; 430/410; 430/547; 430/507; 430/592; 430/593; 430/598

[58] Field of Search ..... 430/378, 409, 410, 547, 430/592, 593, 598, 377, 505, 507

[56] References Cited

U.S. PATENT DOCUMENTS

| | | | |
|---|---|---|---|
| 4,444,871 | 4/1984 | Miyaoka et al. | 430/409 |
| 4,582,779 | 4/1986 | Kubota et al. | 430/592 |
| 4,769,316 | 9/1988 | Miyasaki et al. | 430/593 |
| 4,801,520 | 1/1989 | Inoue et al. | 430/598 |

FOREIGN PATENT DOCUMENTS 0131533 7/1985 Japan .

*Primary Examiner*—Richard L. Schilling
*Attorney, Agent, or Firm*—Sughrue, Mion, Zinn, Macpeak & Seas

[57] ABSTRACT

A direct positive color image forming method which comprises processing an imagewise exposed photographic light-sensitive material with a surface color developing solution containing an aromatic primary amine color developing agent, after fogging treatment and/or during fogging treatment, wherein the photographic light-sensitive material comprises a support having thereon at least one internal latent image type silver halide emulsion layer that has not been previously fogged, a color image forming coupler, colloidal silver, and at least one compound represented by general formula (II):

wherein Z represents an atomic group necessary for completing a 5-membered or 6-membered nitrogen-containing heterocyclic ring; D and D′, which may be the same or different, each individually represents an atomic group necessary for completing an acidic nucleus and D and D′ may be bonded to each other to form a cyclic structure; $R^1$ represents a substituted or unsubstituted alkyl group which may form a salt with a metal atom or an organic compound; $L^1$, $L^2$, $L^3$, $L^4$, $L^5$ and $L^6$, which may be the same or different, each represents a substituted or unsubstituted methine group; $n^1$ and $n^2$ each represents 0 or 1; and l represents an integer from 0 to 3.

In accordance with the method of the present invention, direct positive color images having excellent gradation and color reproducibility are obtained.

16 Claims, No Drawings

DIRECT POSITIVE COLOR IMAGE FORMING METHOD

FIELD OF THE INVENTION

The present invention relates to a direct positive color image forming method, more particularly to a method of forming a direct positive color image having excellent gradation and color reproducibility.

BACKGROUND OF THE INVENTION

Photographic processes for obtaining direct positive images without employing a reversal processing step or a negative film are well known.

Taking practical utility into consideration, conventional techniques for obtaining a positive image from a direct positive silver halide photographic light-sensitive material, exclusive of certain special methods, are divided chiefly into the following two types.

One type employs a previously fogged silver halide emulsion whose fog centers (latent image) in exposed areas are destroyed making use of the solarization or Herschell effect to obtain a direct positive image, after development.

The other type uses an internal latent image type silver halide emulsion not having been fogged, which is imagewise exposed to light and then subjected to surface development either after fogging treatment or during fogging treatment to obtain a direct positive image. The internal latent image type silver halide emulsion used herein is an emulsion in which silver halide grains have sensitivity specks predominantly in the interior thereof and form a latent image predominantly in the interior upon exposure to light.

The various methods belonging to the latter type generally enjoy higher sensitivity and are suitable for uses requiring high sensitivity as compared with the various methods of the former type. The method of the present invention belongs to the latter type.

Various techniques of this type have been known, such as those disclosed, for example, in U.S. Pats. 2,592,250, 2,466,957, 2,497,875, 2,588,982, 3,317,322, 3,761,266, 2,761,276, and 3,796,577, and British Pats. 1,151,363, 1,150,553, and 1,011,062. According to these conventional techniques, photographic materials providing a direct positive image with relatively high sensitivity can be produced.

For the details of the direct positive image formation mechanism, reference can be made to, for example, T.H. James, *The Theory of the Photographic Process,* 4th Ed., Ch. 7, pp. 182 to 193 and U.S. Pat. No. 3,761,276.

It is believed that a direct positive image is formed through the following mechanism: first, imagewise exposure results in the formation of an internal latent image in the inside of silver halide grains, which leads to the formation of fog centers selectively on the surface of the unexposed silver halide grains by surface desensitization based on the internal latent image, and subsequent conventional surface development processing results in formation of a photographic image (a direct positive image) on the unexposed area.

Selective formation of fog centers can be generally effected by a "light fogging method" in which the entire surface of a light-sensitive layer is secondarily exposed to light as described, for example, in British Pat. No. 1,151,363 or a "chemical fogging method" using a nucleating agent as described, for example, in *Research Disclosure,* Vol. 151, No. 15162 (November, 1976), pp. 76 to 78.

In the formation of a direct positive color image, the internal latent image type silver halide light-sensitive material is subjected to surface color development processing either after or simultaneously with fogging treatment and is then subjected to bleaching and fixing (or bleach-fixing). After the bleaching and fixing processing, the material is usually washed with water and/or subjected to stabilizing processing.

According to direct positive image formation by the above-described light fogging method or chemical fogging method, the rate of development is lower, requiring a longer processing time as compared with general negative type photographic materials. Hence, the pH and/or temperature of the developing solution used in these methods may be increased to thereby reduce the development time. However, the use of a developing solution having a higher pH value generally causes an increase in the minimum image density of the resulting direct positive image. Further, the developing agent is more susceptible to deterioration due to air oxidation under a high pH, and the pH is apt to decrease over time due to absorption of carbon dioxide in the air, so that development activity becomes seriously reduced.

In order to solve these problems, compounds which exhibit a nucleating function under a developing solution pH of 12 or lower have been proposed as described, for example, in JP-A-52-69613 (the term "JP-A" as used herein means an "unexamined published Japanese patent application"), and U.S. Pats. 3,615,615 and 3,850,638. However, these compounds also cause an undesired increase in the minimum image density. In addition, the maximum image density obtained is sufficiently low.

On the other hand, certain merocyanine series sensitizing dyes have been employed in a latent image type silver halide emulsion in order to increase the maximum image density as described in U.S. Pat. No. 4,306,016. However, the degree of increase is still unsatisfactory.

Moreover, the increase in the development time in the development processing of internal latent image type direct positive color photographic light-sensitive materials is also problematic in that the toe portion of the characteristic curve of the image obtained tends to be flat.

SUMMARY OF THE INVENTION

Accordingly, one object of the present invention is to provide a direct positive color image forming method which can form a direct positive image having both a sufficiently high maximum color density and a low minimum color density.

Another object of the present invention is to provide a direct positive color image forming method which can form a direct positive image having a high maximum density with less formation of re-reversal negative images even when photographic light-sensitive materials are subjected to continuous running) processing or are preserved under severe conditions, such as high temperatures and/or high humidity.

Other objects of the present invention will become apparent from the following description and examples.

The above-described and other objects and advantages of the present invention can be accomplished by a direct positive color image forming method which comprises processing an imagewise exposed photographic light-sensitive material with a surface color developing solution containing an aromatic primary amine color developing agent, after fogging treatment and/or during fogging treatment, wherein the photographic light-sensitive material comprises a support having thereon at least one internal latent image type silver halide emulsion layer that has not been previously fogged, a color image forming coupler, colloidal silver, and at least one compound represented by general formula (I)

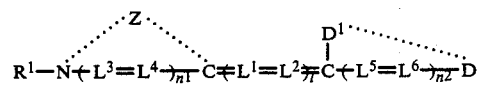

wherein Z represents an atomic group necessary for completing a 5-membered or 6-membered nitrogen-containing heterocyclic ring; D and D', which may be the same or different, each individually represents an atomic group necessary for completing an acidic nucleus and D and D' may be bonded to each other to form a cyclic structure; $R^1$ represents a substituted or unsubstituted alkyl group which may form a salt with a metal atom or an organic compound; $L^1$, $L^2$, $L^3$, $L^4$, $L^5$ and $L^6$, which may be the same or different, each represents a substituted or unsubstituted methine group; $n^1$ and $n^2$ each represents 0 or 1; and l represents an integer from 0 to 3.

DETAILED DESCRIPTION OF THE INVENTION

The compounds represented by general formula (I) used in the photographic material processed in accordance with the present invention will be described in more detail below.

The atomic group forming the heterocyclic ring represented by Z includes a thiazole nucleus (e.g., thiazole, 4-methylthiazole, 4-phenylthiazole, 4,5-dimethylthiazole, 4,5-diphenylthiazole, etc.), a benzothiazole nucleus (e.g., benzothiazole, 4-chlorobenzothiazole, 5-chlorobenzothiazole, 6-chlorobenzothiazole, 5-nitrobenzothiazole, 4-methyl benzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, 4-phenylbenzothiazole, etc.), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), a thiazoline nucleus (e.g., thiazoline, 4-methylthiazoline, 4-nitrothiazoline, etc.), an oxazole nucleus (e.g., oxazole, 4-methyloxazole, 4-nitroxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.), a naphthoxazole nucleus (e.g., naphtho[2,1-d]oxazole, naphtho[1,2-d]oxazole, naphtho[2,3-d]oxazole, 5-nitronaphtho[2,1-d]oxazole, etc.), an oxazoline nucleus (e.g., oxazoline, 4,4-dimethyloxazoline, etc.), a selenazole nucleus (e.g., selenazole, 4-methylselenazole, 4-nitroselenazole, 4-phenylselenazole, etc.), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole, etc.), a naphthoselenazole nucleus (e.g., naphtho[2,1-d]selenazole, naphtho[1,2-d]selenazole, etc.), a selenazoline nucleus (e.g., selenazoline, 4-methylselenazoline, etc.), a tetrazole nucleus (e.g., tetrazole, 4-methyltetrazole, 4-phenyltetrazole, etc.), a benzotetrazole nucleus (e.g., benzotetrazole, 5-chlorobenzotetrazole, 5-methylbenzotetrazole, 5,6-dimethylbenzotetrazole, 6-methoxybenzotetrazole, etc.), a naphthotetrazole nucleus (e.g., naphtho[2,1-d]tetrazole, naphtho[1,2-d]tetrazole, etc.), a tetrazoline nucleus (e.g., tetrazoline, 4-methyltetrazoline, etc.), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5 methoxyindolenine, 3,3,5-trimethylindolenine, 3,3-dimethyl-5-chloroindolenine, etc.), an imidazole nucleus (e.g., 1-alkylimidazole, 1-alkyl-4-phenylimidazole, etc.), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, etc.), a naphthoimidazole nucleus (e.g., 1-alkylnaphtho[1,2-d]imidazole, 1-arylnaphtho[1,2-d]imidazole, etc.), wherein the alkyl group substituted to the imidazole, the benzimidazole and the naphthoimidazole nuclei is preferably an alkyl group having from 1 to 8 carbon atoms, e.g., an unsubstituted alkyl group such as methyl, ethyl, propyl, isopropyl, butyl, etc., or a hydroxyalkyl group such as 2-hydroxyethyl, 3-hydroxypropyl, etc., particularly preferably a methyl group or an ethyl group, and the aryl group of the benzimidazole and the naphthoimidazole nuclei is phenyl, phenyl substituted by a halogen (e.g., chlorine), phenyl substituted by an alkyl (e.g., methyl), phenyl substituted by an alkoxy e.g., methoxy; a pyridine nucleus (e.g., 2-pyridine, 4-pyridine, 5-methyl-2-pyridine, 3-methyl-4-pyridine, etc.), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline, etc.), an isoquinoline nucleus (e.g., 6-nitro-1-isoquinoline, 3,4-dihydro-1-isoquinoline, 6-nitro-3-isoquinoline, etc.), an imidazo[4,5-b]quinoxaline nucleus (e.g., 1,3-diethylimidazo[4,5-b]quinoxaline, 6-chloro-1,3-diallylimidazo[4,5-b]quinoxaline, etc.), an oxadiazole nucleus, a thiadiazole nucleus, a tetrazole nucleus, a pyrimidine nucleus, etc.

D and D' each represents an atomic group necessary for completing an acidic nucleus and may form an acidic nucleus for any conventional merocyanine dye. D preferably represents a cyano group, a sulfonyl group or a carbonyl group and D' preferably represents the remainder of the atomic group necessary for completing the acidic nucleus.

When D and D' each represents a non-cyclic structure, that is, they are individual groups, the terminal group of the methine bond is a group such as malononitrile, alkylsulfonylacetonitrile, cyanomethylbenzofuranylketone or cyanomethylphenylketone.

D and D' may combine with each other to form a 5-membered or 6-membered heterocyclic ring which composed of carbon, nitrogen and chalcogen atoms (typically oxygen, sulfur, selenium and tellurium).

Preferred nuclei which can be formed by D and D' include 2-pyrazolin-5-one, pyrazolidine-3,5-dione, imidazolin-5-one, hydantoin, 2- or 4-thiohydantoin, 2-iminooxazolidine-4-one, 2-oxazolin-5-one, 2-thiooxazolidine-2,4-dione, isooxazolin-5-one, 2-thiazolin-4-one, thiazolidine-4-one, thiazolidine-2,4-dione, rhodanine, thiazolidine-2,4-dithione, isorhodanine, indane-1,3-dione, thiophen 3-one, thiophen-3-one-1,1-dioxide, isoindolin-2-one, isoindolin-3-one, indazolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, and pyrido[1,2-a]pyrimidine-1,3-dione.

When D or D' is a substituent, the substituent bonded is to a nitrogen atom contained in the abovedescribed nucleus. The substituent is preferably a hydrogen atom, an alkyl group having from 1 to 18 carbon atoms, preferably having from 1 to 7 carbon atoms, and particularly preferably having from 1 to 4 carbon atoms (e.g., methyl, ethyl, propyl, isopropyl, butyl, isobutyl, hexyl, octyl, dodecyl, or octadecyl), a substituted alkyl group (for example, an aralkyl group (e.g., benzyl, or 2-phenylethyl), a hydroxyalkyl group (e.g., 2-hydroxyethyl, or 3-hydroxypropyl), a carboxyalkyl group (e.g., 2-carboxyethyl, 3-carboxypropyl, 4-carboxybutyl, or carboxymethyl), an alkoxyalkyl group (e.g., 2-methoxyethyl, or 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, or 3-sulfopropoxyethoxyethyl), a sulfate alkyl group (e.g., 3-sulfate propyl group, or 4-sulfate butyl group), an aminoalkyl group (e.g., 2-aminoethyl, 2-(N,N-dimethylamino)ethyl, or 3-(N,N-diethylamino)-propyl), a heterocyclic ring-substituted alkyl group (e.g., 2-(pyrrolidin-2-one-1-yl)ethyl, tetrahydrofurfuryl, or 2-morpholinoethyl), 2-acetoxyethyl, carbomethoxymethyl, or 2-methanesulfonylaminoethyl), an amino group, an allyl group, an aryl group (e.g., phenyl, or 2-naphthyl), a substituted aryl group (e.g., 4-carboxyphenyl, 4-sulfophenyl, 3-chlorophenyl, or 3-methylphenyl), or a heterocyclic group (e.g., 2-pyridyl, or 2-thiazolyl).

More preferred examples of the substituent are an aminoalkyl group (e.g., 2-aminoethyl, 2-(N,N-dimethylamino)ethyl, or 3-(N,N-diethylamino)propyl), an amino group and an unsubstituted alkyl group (e.g., methyl, or ethyl).

The alkyl group represented by $R^1$ may be substituted. $R^1$ preferably represents an unsubstituted alkyl group having up to 18 carbon atoms (e.g., methyl, ethyl, propyl, butyl, pentyl, octyl, decyl, dodecyl, or octadecyl) or a substituted alkyl group (preferably having up to 18 carbon atoms, substituted with, for example, a carboxy group, a sulfo group, a cyano group, an amino group, a halogen atom (e.g., fluorine, chlorine, or bromine), a hydroxy group, an alkoxycarbonyl group having up to 8 carbon atoms (e.g., methoxycarbonyl, ethoxycarbonyl, phenoxycarbonyl, or benzyloxycarbonyl), an alkoxy group having up to 8 carbon atoms (e.g., methoxy, ethoxy, benzyloxy, or phenethyloxy), a monocyclic aryloxy group having up to 10 carbon atoms (e.g., phenoxy, p-tolyloxy), an acyloxy group having up to 3 carbon atoms (e.g., acetyloxy, or propionyloxy), an acyl group having up to 8 carbon atoms (e.g., acetyl, propionyl, benzoyl, or mesyl), a carbamoyl group (e.g., carbamoyl, N,N-dimethylcarbamoyl, morpholinocarbonyl, or piperidinocarbonyl), a sulfamoyl group (e.g., sulfamoyl, N,N-dimethylsulfamoyl, morpholinosulfonyl group, or piperidinosulfonyl), an aryl group having up to 10 carbon atoms (e.g., phenyl, 4-chlorophenyl, 4-methylphenyl, or 2-naphthyl), etc.

Particularly preferred examples for $R^1$ are an alkyl group substituted with an amino group (e,g., 2-aminoethyl, 2-(N,N-dimethylamino)ethyl, or 3-(N,N-diethylamino)propyl) and an unsubstituted alkyl group (e,g., methyl, or ethyl).

A particularly preferred metal atom which can form a salt with $R^1$ is an alkali metal (for example, Na, K), and particularly preferred organic compounds which can form a salt with $R^1$ includes a pyridine and an amine.

$L^1$, $L^2$, $L^3$, $L^4$, $L^5$ and $L^6$, which may be the same or different, each represents a methine group which may be unsubstituted or substituted with a substituent selected from a substituted or unsubstituted alkyl group (e.g., methyl, or ethyl), a substituted or unsubstituted aryl group (e.g., phenyl) and a halogen atom (e.g., chlorine, or bromine).

Further, the methine group may form a ring together with other methine groups or may form a ring together with the auxochrome. $L^1$ and $L^2$ each preferably represents an unsubstituted methine group.

Typical examples of the compounds represented by general formula (I) are set forth below, but the present invention should not be construed as being limited thereto.

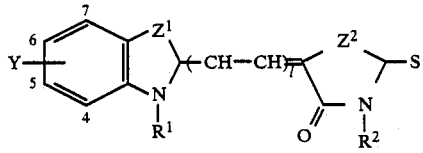

| Compound | $R^1$ | $R^2$ | $Z^1$ | $Z^2$ | Y | l |
|---|---|---|---|---|---|---|
| (1) | $(CH_2)_4SO_3H.N(C_2H_5)_3$ | $NH_2$ | S | S | 5-$OCH_3$ | 0 |

-continued

| | | | | | | |
|---|---|---|---|---|---|---|
| (2) | $C_2H_5$ | $^n$-$C_6H_{13}$ | S | O | H | 1 |
| (3) | $C_2H_5$ | $(CH_2)_3N(C_2H_5)_3$ | S | S | H | 1 |
| (4) | $C_2H_5$ | $(CH_2)_4SO_3Na$ | S | S | H | 0 |
| (5) | $CH_3$ | $-NH_2$ | S | S | H | 0 |
| (6) | $C_2H_5$ | $(CH_2)_3SO_3Na$ | S | S | H | 0 |
| (7) | $CH_2CO_2H$ | $C_2H_5$ | S | S | 4,5-benzo | 0 |
| (8) | $CH_3$ | $CH_3$ | S | S | 6,7-benzo | 0 |
| (9) | $C_2H_5$ | $(CH_2)_2N(CH_3)_2$ | S | S | H | 0 |
| (10) | $C_2H_5$ | $^n$-$C_5H_{11}$ | S | S | H | 2 |
| (11) | $(CH_2)_3SO_3H.N(C_2H_5)_3$ | $C_2H_5$ | Se | S | H | 0 |
| (12) | $(CH_2)_3SO_3H.N(C_2H_5)_3$ | $C_2H_5$ | S | S | H | 0 |
| (13) | $C_2H_5$ | $C_2H_5$ | S | S | H | 2 |
| (14) | $(CH_2)_4SO_3H.N(C_2H_5)_3$ | $(CH_2)_2OH$ | S | S | 5-$OCH_3$ | 0 |
| (15) | $CH_3$ | $C_2H_5$ | S | O | 5,6-$(CH_3)_2$ | 0 |
| (16) | $CH_2CO_2H$ | $CH_2CO_2H$ | S | O | H | 1 |
| (17) | $^nC_3H_7$ | 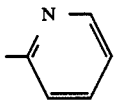 | S | O | 5-Cl | 2 |
| (18) | $C_2H_5$ | $-Ph$ | O | S | H | 0 |
| (19) | $C_2H_4OCH_3$ | $C_2H_4OCH_3$ | O | S | 5-Ph | 1 |
| (20) | $(CH_2)_3SO_3H.N(C_2H_5)_3$ | $CH_2-PH$ | O | S | H | 0 |
| (21) | 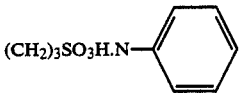 | Ph | O | $N-(CH_2)_2O(CH_2)_2OH$ | 5-Cl | 1 |
| (22) | $(CH_2)_3SO_3Na$ | $C_2H_5$ | O | $N-C_2H_5$ | H | 1 |
| (23) | $C_2H_5$ | Ph | O | 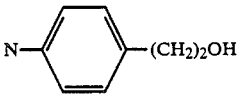 | H | 1 |
| (24) | $(CH_2)_4SO_3K$ | Ph | O | $N-(CH_2)_2O(CH_2)_2OH$ | H | 1 |
| (25) | $(CH_2)_3SO_3K$ | $CH_3$ | O | $N-(CH_2)_2O(CH_2)_2OH$ | 5-Cl | 1 |
| (26) | 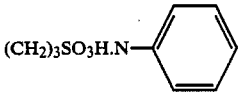 | $C_2H_5$ | Se | O | 5-Cl | 0 |
| (27) | $C_2H_5$ | $(CH_2)_3SO_3K$ | $-CH=CH-$ | S | H | 0 |
| (28) | $CH_3$ | $CH_3$ | Te | S | H | 2 |
| (29) | $CH_3$ | $C_2H_5$ | O | Te | 5-Ph | 0 |
| (30) | $CH_2CO_2H$ | $C_2H$ | $N-C_2H_5$ | S | 5,6-$Cl_2$ | 2 |

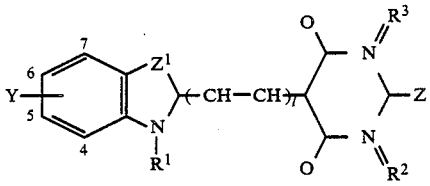

| Compound | $R^1$ | $R^2$ | $R^3$ | $Z^1$ | $Z^2$ | Y | l |
|---|---|---|---|---|---|---|---|
| (31) | $(CH_2)_3SO_3H.N(C_2H_5)_3$ | $C_2H_5$ | $C_2H_5$ | S | S | 5-$OCH_3$ | 0 |
| (32) | $(CH_2)_2N(CH_3)_2$ | $(CH_2)_3SO_3K$ | $C_2H_5$ | S | S | H | 1 |
| (33) | $C_2H_5$ | $(CH_2)_3N(C_2H_5)_2$ | $CH_3$ | S | S | 5-Cl | 1 |
| (34) | $^nC_3H_7$ | $^n$-$C_4H_9$ | $^n$-$C_4H_9$ | S | O | H | 2 |
| (35) | $C_2H_5$ | $C_2H_5$ | $C_2H_5$ | O | O | 5-Ph | 0 |
| (36) | $C_2H_5$ | $(CH_2)_2SO_3Na$ | $CH_3$ | O | O | 5-Cl | 1 |

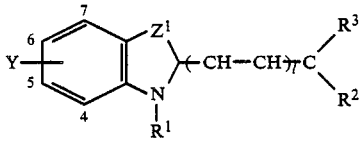

| Compound | $R^1$ | $R^2$ | $R^3$ | $Z^1$ | Y | l |
|---|---|---|---|---|---|---|
| (37) | $C_2H_5$ | CN | CN | S | 5-$OCH_3$ | 0 |
| (38) | $(CH_2)_4SO_3H.N(C_2H_5)_3$ | $SO_2CH_3$ | CN | O | 5-Ph | 0 |

-continued

| | | | | | | |
|---|---|---|---|---|---|---|
| (39) | $CH_2CO_2H$ | $COC_2H_5$ | CN | Se | H | 1 |
| (40) | $(CH_2)_4SO_3K$ | $COC_2H_5$ | CN | $N-C_2H_5$ | 5,6-$Cl_2$ | 1 |
| (41) | $^mC_3H_7$ | $SO_2CH_3$ | $SO_2CH_3$ | S | 5-$CH_3$ | 2 |

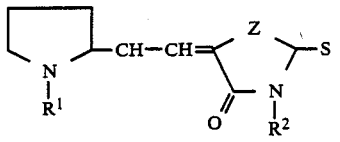

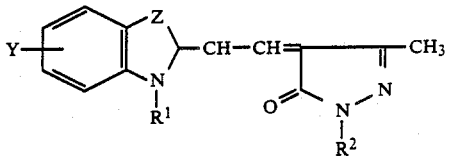

| Compound | $R^1$ | $R^2$ | Z | Compound | $R^1$ | $R^2$ | Z | Y |
|---|---|---|---|---|---|---|---|---|
| (48) | $CH_3$ | $CH_3$ | $N-C_2H_5$ | (51) | $C_2H_5$ | $(CH_2)_3SO_3K$ | S | H |
| (49) | $C_2H_5$ | $C_2H_5$ | S | (52) | $CH_3$ | —Ph | $C(CH_3)_2$ | 6-$CH_3$ |
| (50) | $C_2H_5$ | $C_2H_5$ | O | | | | | |

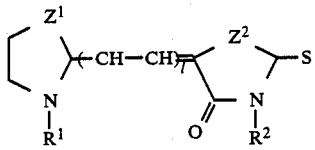

| Compound | $R^1$ | $R^2$ | $Z^1$ | $Z^2$ | l |
|---|---|---|---|---|---|
| (53) | $CH_3$ | $C_2H_5$ | S | S | 1 |
| (54) | $(CH_2)_3SO_3Na$ | $C_2H_5$ | S | S | 1 |
| (55) | $C_2H_5$ | $CH_2CO_2H$ | S | S | 1 |
| (56) | $(CH_2)_3SO_3Na$ | Ph | S | S | 1 |
| (57) | 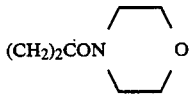 | $C_2H_5$ | S | S | 1 |
| (58) | $CH_3$ | $C_2H_5$ | S | O | 1 |
| (59) | $(CH_2)_3SO_3Na$ | $CH_3$ | O | $N-CH_3$ | 0 |
| (60) | $C_2H_5$ | $CH_2CO_2H$ | S | S | 0 |

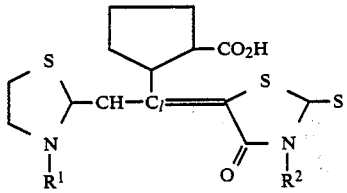

| Compound | $R^1$ | $R^2$ |
|---|---|---|
| (61) | $C_2H_5$ | $CH_2$—Ph |
| (62) | $CH_3$ | $C_2H_5$ |
| (63) | $C_2H_5$ | $C_2H_5$ |
| (64) | $C_2H_5$ | $CH_2CH=CH_2$ |
| (65) | 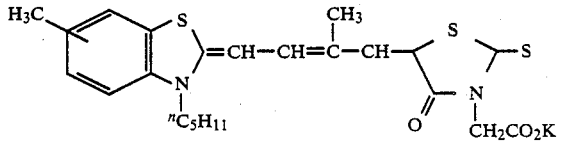 | |
| (66) | 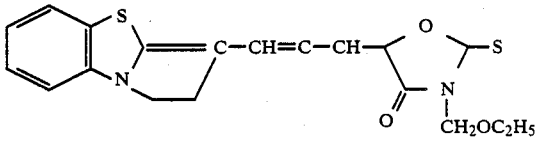 | |

The sensitizing dyes represented by general formula (I) which are employed in the present invention can be easily synthesized based on the methods as described, for example, in F.M. Hamer, *Heterocyclic Compounds-Cyanine Dyes and Related Compounds,* Chapter XIV, pages 511 to 611, John Wiley and Sons (1964), D.M. Sturmer, *Heterocyclic Compounds-Special Topics in Heterocyclic Chemistry,* Chapter VIII, sec. IV, pages 482 to 515, John Wiley and Sons (1977), etc.

The sensitizing dye represented by general formula (I) is preferably incorporated into an interial latent image type silver halide emulsion layer. The amount incorporated is in a range from $1\times10^{-6}$ to $1\times10^{-2}$ mol, preferably from $1\times10^{31\ 5}$ to $1\times10^{-3}$ mol, more preferably from $5\times10^{-5}$ to $8\times10^{-4}$ mol, per mol of silver.

Two or more sensitizing dyes represented by general formula (I) according to the present invention can be employed together; also, they may be employed together with other merocyanine dyes, cyanine dyes and polymethine dyes.

Colloidal silver, which is used in the method of forming a direct positive image according to the present invention, may have any color, e.g., yellow, brown, blue, black, etc. The layer in which colloidal silver is incorporated is not particularly limited, and can be selected appropriately from emulsion layers and non-emulsion layers (light-insensitive layers), and preferably from layers adjacent to emulsion layers.

It is preferred that two or more colloidal silver containing layers are present in the photographic light-sensitive material. At least one layer of the colloidal silver containing layers is preferably provided below (i.e. nearer the support a blue-sensitive layer in order to also fulfill its function as a yellow filter.

The amount of the colloidal silver to be added in the photographic material preferably ranges from 0.0001 to 0.4 g/m$^2$, and more preferably from 0.0003 to 0.3 g/m$^2$.

Preparation of various types of colloidal silver is described in, e.g., Weiser, *Colloidal Elements,* Wiley & Sons, New York (1933) concerning yellow colloidal silver prepared by a Carey Lea's Dextrin reduction method; German Pat. No. 1,096,193 concerning brown or black colloidal silver; and U.S. Pat. No. 2,688,601 concerning blue colloidal silver.

Reducing agents which can be used in the preparation of colloidal silver are known, and conventional reducing agents for the preparation of colloidal silver dispersions include, for example, phenols, e.g., hydroquinone, methylhydroquinone, t-butylhydroquinone, pyrogallol, pyrocatechin, p-phenylenediamine, 1,4-dihydronaphthalene, etc.; and 5-membered ring compounds, e.g., 1-phenyl-3-pyrazolidone, 1-(p-aminophenol)-3-amino-2-pyrazolidone, etc. These and many other specific examples of suitable reducing agents are described, for example, in C.E.K. Mees and T. H. James, *The Theory of the Photographic Process,* 3rd Ed., pp. 278–306. Reducing sugars, such as dextrin, glucose, etc., may also be employed. In addition to the above-described organic compounds, inorganic compounds, such as sodium boron hydride, potassium boron hydride, t-butylamino borane, dithionites, ferrous oxalate, sodium hydrosulfite, hydroxylamine, hydrazine, and salts of a polyvalent metal (e.g., titanium, vanadium, tin, etc.), may also be used as effective reducing agents in the present invention.

The preparation of colloidal silver may also be carried out according to the methods disclosed in German patent application (OLS) No. 1,917,745, JP-B-53-6636 (the term "JP-B" as used herein means an "examined Japanese patent publication"), JP-A-51-89722, and U.S. Pat. No. 4,094,811.

The reducing agent is used in an amount of from about 0.5 to 10 mols, and preferably from 0.8 to 5 mols, per mol of silver.

Silver salts suitable for the preparation of colloidal silver include water-soluble silver salts, such as silver nitrate, ammonium silver complex salts, etc.; and fine dispersions of silver salts, such as silver halides (e.g., silver chloride, silver bromide, silver iodide, silver chlorobromide, etc.).

In the preparation of a coating composition for a colloidal silver-containing layer, a protective colloid may or may not be present at the time of mixing but should be present at least before washing of a dispersion.

Protective colloids that may be used include starch, dextran, amylolysis products of starch (e.g., dextrin, etc.); proteins, such as gelatin and the like natural polymer, gelatin derivatives, graft polymers of gelatin and other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and various synthetic hydrophilic polymers, such as polyvinyl alcohol, polyvinyl alcohol partial acetal, poly-N-vinylpyrrolidone, polyacrylic acid, polymethacrylic acid, polyacrylamide, polyvinyl pyrrolidone, polyvinylimidazole, polyvinylpyrazole, etc., and copolymers comprising monomers constituting these homopolymers.

Gelatins that may be used as a protective colloid may be any of lime-processed gelatin, acid-processed gelatin, enzyme-processed gelatin as described in *Bull. Soc. Sci. Phot. Japan,* No. 16, page 30 (1966), and hydrolysates or enzymatic decomposition products of gelatin.

Gelatin derivatives that may be used as a protective colloid can be obtained by reacting gelatin with various compounds, such as acid halides, acid anhydrides, isocyanates, bromoacetic acid, alkanesulfones, vinylsulfonamides, maleimide compounds, polyalkylene oxides, epoxy compounds, and so on.

Stirring, concentration, and the like in the preparation of colloidal silver are carried out in a usual manner. The technique described in JP-A-58-91103 and U.S. Pat. No. 4,429,038 may also be used.

The internal latent image type silver halide emulsion that is not previously fogged which is used in the present invention is an emulsion containing silver halide grains which form a latent image mainly in the interior thereof, the surface of which has not been previously fogged. More specifically, suitable emulsions have the characteristic that when coated on a transparent support in a predetermined amount ranging from 0.5 g/m$^2$ to 3 g/m$^2$ in terms of silver, exposed to light for a fixed time between 0.01 and 10 seconds, then developed at 18° C. for 5 minutes with the following developing solution A (an internal developer), provide a maximum density (measured by a conventional photographic density measuring method) of at least about 5 times, more preferably at least about 10 times, as much as that obtained by coating and exposing the emulsion in the same manner as described above, but developing at 20° C for 6 minutes with the following developing solution B (a surface developer):

| | |
|---|---|
| Internal developer A | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Surface developer B | |
| Metol | 2.5 g |
| l-Ascorbic acid | 10 g |
| NaBO.4HO | 35 g |

-continued

| | |
|---|---|
| KBr | 1 g |
| Water to make | 1 liter |

Specific examples of suitable internal latent image type emulsions include conversion type silver halide emulsions as described, for example, in U.S. Pat. No. 2,592,250, and core/shell type silver halide emulsions as described, for example, in U.S. Pats. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, JP-A-62-215272, and the patents cited in *Research Disclosure,* No. 23510 (November, 1983) page 236.

The silver halide grains used in the internal latent image type emulsion of the present invention may have a regular crystal form, such as a cubic, octahedral, dodecahedral or tetradecahedral form, an irregular crystal form, such as a spherical form, a tabular form having a length/thickness ratio of 5 or more, or a composite crystal form thereof. Further, an emulsion composed of a mixture of these grains may be employed.

The halogen composition of the silver halide grains includes silver chloride, silver bromide, and a mixed silver halide. The silver halide preferably used in the present invention is selected from those containing no silver iodide or containing up to 3 mol% of silver iodide, i.e., silver chloro(iodo)bromide, silver (iodo)chloride and silver (iodo)bromide.

The silver halide grains preferably have an average grain size of from 0.1 to 2 μm, and more preferably from 0.15 to 1 μm.

Grain size distribution may be either narrow or broad, but it is preferable from the standpoint of improvement of graininess, sharpness, and the like to use a so-called "monodispersed" silver halide emulsion having a narrow size distribution in which at least 90% of the number or weight of the total grains fall within a size range of ±40%, preferably ±20%, of the mean grain size.

In order to satisfy the gradation required for the photographic light-sensitive material, in emulsion layers having substantially the same color sensitivity, two or more monodispersed silver halide emulsions different in grain size or having a plurality of grains of the same size but different in sensitivity are mixed in the same layer or are applied as different layers that are superposed. Two or more polydispersed silver halide emulsions or a monodispersed silver halide emulsion and a polydispersed silver halide emulsion can be used in the form of a mixture or in superposed layers.

In the silver halide emulsion used in the present invention, the interior or the surface of the grains may be chemically sensitized by sulfur sensitization, selenium sensitization, reduction sensitization or noble metal sensitization. These sensitization methods can be used alone or in combination. Specific examples of suitable chemical sensitization methods are described, for example, in the patents cited in *Research Disclosure,* No. 17643-III (December, 1978), page 23.

The photographic emulsion used in the present invention may be further spectrally sensitized with a photographic sensitizing dye in a conventional manner. Particularly useful dyes are cyanine dyes, merocyanine dyes and complex merocyanine dyes, which may be used alone or in combination, and also can be used in combination with supersensitizers. Specific examples thereof are described, for example, in the patents cited in *Research Disclosure,* No. 17643-IV (December, 1978), pages 23 to 24.

The photographic emulsions used in the present invention can contain an antifoggant or a stabilizer for the purpose of stabilizing the photographic performance, or for preventing formation of fog during the production, storage or photographic processing of the photographic light-sensitive material. Specific examples of antifoggants and stabilizers are described, for example, in *Research Disclosure,* No. 17643-VI (December, 1978), and E.J. Birr, *Stabilization of Photographic Silver Halide Emulsions,* 1974 (Focal Press), etc.

In order to form direct positive color images, various color image forming couplers can be employed. Useful color couplers are compounds that can undergo a coupling reaction with an oxidation product of an aromatic primary amine type color developing agent to produce or release a dye which is substantially nondiffusible. The color coupler themselves are preferably substantially non-diffusible.

Magenta couplers preferably employed in the present invention are represented by the following general formula (II):

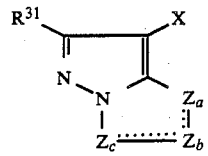

(II)

wherein $R^{31}$ represents a hydrogen atom or a substituent; X represents a hydrogen atom or a group capable of being released upon a coupling reaction with an oxidation product of an aromatic primary amine developing agent; $Z_a$, $Z_b$, and $Z_c$, which may be the same or different, each represents a melhine group, a substituted methine group, =N— or —NH—, provided that one of $Z_a$–$Z_b$ bond and $Z_b$–$Z_c$ bond is a double bond and the other is a single bond; when $Z_b$–$Z_c$ is a carbon-carbon double bond, $Z_b$–$Z_c$ may be a part of a condensed aromatic ring; when $R^{31}$ or X is a divalent group, the compound of general formula (II) may form a polymer including a dimer or higher polymer; when $Z_a$, $Z_b$ or $Z_c$ is a substituted methine group, the compound of general formula (II) may form a polymer including a dimer or higher polymer.

Specific examples of the above described pyrazoloazole type magenta couplers of general formula (I) which can be used are described, for example, in JP-A-60-262158 and Japanese patent application No. 62-179142, pages 17 to 24.

The above-described magenta couplers may be employed together with other magenta couplers.

Specific examples of cyan, magenta and yellow couplers which can be used in the present invention are described, for example, in *Research Disclosure,* No. 17643 (December, 1978), page 25, section VII-D; ibid., No. 18717 (November, 1979) and JP-A-62-215272, and compounds described in the patents cited therein.

Among others, typical yellow couplers that can be used in the present invention include yellow twoequivalent couplers of the oxygen atom releasing or nitrogen atom releasing type. Particularly, α-pivaloylacetanilide type couplers are excellent in fastness, in particular light-fastness, of the dyes formed therefrom, while α-benzoylacetanilide type couplers are preferred because a high color density can be obtained.

Cyan couplers preferably used in the present invention include naphtholic and phenolic couplers as described, for example, in U.S. Pats. 2,474,293 and 4,502,212, and phenolic cyan couplers having an alkyl group containing two or more carbon atoms at the m-position of the phenol nucleus as described in U.S. Pat. No. 3,772,002. In addition, 2,5-diacylamino-substituted phenolic couplers are also preferred in view of fastness of color image formed therefrom.

Colored couplers for correcting undesired absorption in the short wavelength range of produced dyes, couplers capable of forming dyes with appropriate diffusibility, non-color forming couplers, DIR couplers that can release a development inhibitor as a result of the coupling reaction, and polymerized couplers can also be used.

Generally, the amount of a color coupler used is in the range of about 0.001 to 1 mol per mol of light-sensitive silver halide. Preferably in the case of a yellow coupler the amount is 0.01 to 0.5 mol per mols of light-sensitive silver halide, in the case of a magenta coupler the amount is 0.03 to 0.5 mol per mol of light-sensitive silver halide, and in the case of a cyan coupler the amount is 0.002 to 0.5 mol per mol of light-sensitive silver halide.

In the present invention, a color formation reinforcing agent can be employed for the purpose of increasing the color forming property of the coupler. Representative examples of such compounds are described in JP-A-62-215272, pages 374 to 391.

The couplers used in the present invention are dissolved in an organic solvent having a high boiling point and/or an organic solvent having a low boiling point, the solution is finely emulsified or dispersed in an aqueous solution of gelatin or other hydrophilic colloids by means of high speed agitation using a homogenizer, etc., a mechanical procedure using a colloid mill, etc. or a technique using ultrasonic wave, and then the emulsified dispersion is mixed with a photographic emulsion, followed by coating to form a layer. In this case, although it is not always necessary to employ an organic solvent having a high boiling point, it is preferred to use such an organic solvent having a high boiling point, specific examples of which include the compounds as described in JP-A-62-215272, pages 440 to 467.

The couplers used in the present invention can be dispersed in a hydrophilic colloid according to the methods as described in JP-A-62-215272, pages 468 to 475.

The photographic light-sensitive material to be processed in accordance with the present invention may contain, as a color fog preventing agent or color mixing preventing agent, hydroquinone derivatives, aminophenol derivatives, amines, gallic acid derivatives, catechol derivatives, ascorbic acid derivatives, non-color forming couplers, sulfonamidophenol derivatives, etc. Typical examples of color fog preventing agents and color mixing preventing agents are described in JP-A-62-215272, pages 600 to 630.

In the photographic light-sensitive material used in the present invention, various color fading preventing agents can be used. Typical organic color fading preventing agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives obtained by the silylation or alkylation of the phenolic hydroxyl group of these compounds. Further, metal complexes such as (bissalicylalkoxymato)nickel complex and (bis-N,N-dialkyldithiocarbamato)nickel complexes can be used.

For the purpose of preventing yellow dye images from being deteriorated by heat, humidity and light, compounds having both a hindered amine structure and a hindered phenol structure in a single molecule, as described in U.S. Pat. No. 4,268,593, give good results. For the purpose of preventing magenta dye images from being deteriorated, particularly by light, spiroindanes as described in JP-A-56-159644 and chromans substituted with hydroquinone diethers or monoethers as described in JP-A-55-89835 give good results.

Typical examples of these color fading preventing agents are described in JP-A-62 215272, pages 401 to 440. The desired object can be attained when these compounds are added to light-sensitive layers generally in amounts of 5 to 100 wt% based on the respective color couplers by co-emulsifying them with the couplers.

For the purpose of preventing cyan dye images from being deteriorated by heat and, particularly, light, it is effective to introduce an ultraviolet light absorbing agent into both layers adjacent to a cyan color image forming layer. An ultraviolet light absorbing agent can also be added to a hydrophilic colloid layer such as protective layer. Typical examples of such compounds are described in JP-A-62-215272, pages 391 to 400.

As binders or protective colloids which can be used in emulsion layers and intermediate layers of the photographic light-sensitive material to be processed according to the present invention, it is advantageous to use gelatin, but hydrophilic colloids other than gelatin can also be used.

The photographic light-sensitive material to be processed according to the present invention can contain dyes for preventing irradiation or halation, ultraviolet light absorbing agents, plasticizers, fluorescent brightening agents, matting agents, aerial fog preventing agents, coating aids, hardening agents, antistatic agents, lubricants, etc. Typical examples of these additives are described in *Research Disclosure,* No. 17643, sections VIII to XIII (December, 1978), pages 25 to 27, and ibid., No. 18716 (November, 1979), pages 647 to 651.

The present invention can be applied to multilayer multicolor photographic materials having at least two emulsion layers having different spectral sensitivities on a support. Generally, a multilayer natural color photographic material has at least one red-sensitive emulsion layer, at least one green-sensitive emulsion layer and at least one blue-sensitive emulsion layer on a support. The order of these layers is appropriately selected as desired. In a preferred layer sequence, a red-sensitive emulsion layer, a green-sensitive emulsion layer and a blue-sensitive emulsion layer are coated in that order on a support, or a green-sensitive emulsion layer, a red-sensitive emulsion layer and a blue-sensitive emulsion layer are coated in that order on a support. Each of these emulsion layers may consist of two or more emulsion layers different in sensitivity, or may consist of two or more emulsion layers having the same sensitivity with a light-insensitive layer between them. Generally, the red-sensitive emulsion layer contains a cyan forming coupler, the green-sensitive emulsion layer contains a magenta forming coupler and the blue-sensitive emulsion layer contains a yellow forming coupler, but in some cases the combination can be changed.

For the purpose of increasing maximum image density, for reducing minimum image density, for improving preservability of the photographic light-sensitive material, and for quickening the development, the following compounds can be added to the photographic material: hydroquinones (e.g., compounds as described in U.S. Pat. Nos. 3,227,552 and 4,279,987); chromans (e.g., compounds as described in U.S. Pat. No. 4,268,621, JP-A-54-103031 and *Research Disclosure,* No. 18264 (June, 1979), pages 333 to 334); quinones (e.g., compounds as described in *Research Disclosure,* No. 21206 (December, 1981), pages 433 to 434); amines (e.g., compounds as described in U.S. Pat. No. 4,150,993 and JP-A-58-174757); oxidizing agents (e.g., compounds as described in JP-A-60-260039 and *Research Disclosure,* No. 16936 (May, 1978), pages 10 to 11); catechols (e.g., compounds as described in JP-A-55-21013 and JP-A-55-65944); compounds capable of releasing a nucleating agent at the time of development (e.g., compounds as described in JP-A-60-107029), thioureas (e.g., compounds as described in JP-A-60-95533); and spirobisindanes (e.g., compounds as described in JP-A-55-65944).

It is preferable that the photographic light-sensitive material to be processed according to the invention is provided with suitable auxiliary layers such as a protective layer, an intermediate layer, a filter layer, an antihalation layer, a backing layer and a white reflective layer, in addition to the silver halide emulsion layers.

In the photographic light-sensitive materials to be processed according to the present invention, the photographic emulsion layers and other layers may be applied on a support by the methods described in *Research Disclosure,* No. 17643, section XVII (December, 1978), page 28, European Pat. No. 0,182,253, and JP-A-61-97655. Further, the coating methods described in *Research Disclosure,* No. 17643, section XV, pages 28 to 29 can be employed.

The present invention may be applied to various types of color photographic light-sensitive materials.

For instance, color reversal films for slides and television, color reversal papers, instant color films, etc. are typical examples. In addition, the present invention may be applied to color hard copies for preserving images of full color copiers or CRT. The present invention is also applicable to black-and-white photographic light-sensitive materials utilizing mixing of three color couplers, as described in *Research Disclosure,* No. 17123 (July, 1978), etc.

The fogging exposure step, that is, exposing the whole surface of the light-sensitive layer to light, in the "light fogging method" according to the present invention is carried out after the imagewise exposure, and before and/or during the development treatment of the photographic material. While the light-sensitive material that has been exposed to light imagewise is dipped in a developing solution or a bath prior to the developing solution, it is subjected to fogging exposure, or after the material is taken out from the solution or the bath, it is subjected to fogging exposure while it is still wet. The fogging exposure step during immersion in the developing solution is particularly preferred.

As a light source for the fogging exposure step, any light source having wavelengths in the range of the light-sensitive wavelength of the light-sensitive material can be used. Generally, a fluorescent lamp, a tungsten lamp, a xenon lamp, sunlight, etc. can be used. Specific methods for the fogging exposure step are described, for example, in British Pat. No. 1,151,363, JP-B-45-12710, JP-B-45-12709, JP-B-58-6936, JP-A-48-9727, JP-A-56-137350, JP-A-57-129438, JP-A-58-62652, JP-A-58-60739, JP-A-58-70223 (corresponding to U.S. Pat. No. 4,440,851) and JP-A-58-120248 (corresponding to European Pat. No. 89101A2). In the case of a light-sensitive material having a sensitivity to the visible length range, such as a color light-sensitive material, a light source high in color rendition (a light source nearer white) as described in JP-A-56-137350 and JP-A-58-70223 is preferred. It is suitable that the illumination of light be 0.01 to 2000 lux, preferably 0.05 to 30 lux, and more preferably 0.05 to 5 lux. The higher the sensitivity of the emulsion used in a light-sensitive material, the more preferred is exposure with a lower illumination. The adjustment of the illumination may be effected by varying the intensity of the light source, reducing the amount of light by various filters, or varying the distance or the angle between the light-sensitive material and the light source. Further, the illumination of fogging exposure can be increased continuously or stepwise from low illumination to high illumination.

It is preferred that fogging exposure is performed after the light-sensitive material is dipped in a developing solution or a bath prior to the developing solution so that the solution thoroughly penetrates into the emulsion layer. Generally, the time between penetration of the solution and light fogging exposure is from 2 seconds to 2 minutes, preferably from 5 seconds to 1 minute, and more preferably from 10 seconds to 30 seconds.

The exposure time for fogging is generally from 0.01 second to 2 minutes, preferably from 0.1 second to 1 minute, and more preferably from 1 second to 40 seconds.

In the present invention, a nucleating agent which is employed when a so-called "chemical fogging method" is performed can be incorporated into the photographic light-sensitive material or into a processing solution for the light-sensitive material. The nucleating agent is preferably incorporated into the photographic light-sensitive material. Further, it is more preferred to employ it together with a nucleation accelerating agent.

The term "nucleating agent" as used herein means a substance which acts to form a direct positive image when an internal latent image type silver halide emulsion not having been previously fogged is subjected to surface development processing.

When the nucleating agent used in the present invention is incorporated into the light-sensitive material, although it is preferable that it is added to an internal latent image type silver halide emulsion layer, it can also be added to other layers such as an intermediate layer, a subbing layer or a backing layer so long as the nucleating agent diffuses during application or processing so as to be adsorbed onto silver halide. When the nucleating agent is added to a processing solution, it can be added to a developing solution or a prior bath having a low pH as described in JP-A-58-178350.

When the nucleating agent is incorporated into the silver halide emulsion layer of the photographic light-sensitive material, preferably the amount thereof is from $10^{-8}$ to $10^{-2}$ mol, more preferably from $10^{-6}$ to $10^{-3}$, per mol of silver halide contained in an emulsion layer. When the nucleating agent is incorporated into other layers, the amount thereof is from $1.0\times10^{-7}$ to $1.0\times10^{-3}$ g/m$^2$, preferably from $5.0\times10^{-7}$ to $1.0\times10^{-4}$ g/m$^2$.

When the nucleating agent is added to the processing solution, preferably the amount of the nucleating agent is from $10^{-5}$ to $10^{-1}$ mol, more preferably from $10^{-4}$ to $10^{-2}$ mol, per liter thereof.

Moreover, two or more kinds of nucleating agents can be employed in combination.

The nucleating agents which can be used in the present invention are described in JP-A-58-178350, page 50, line 1 to page 53. Particularly, the compounds represented by the general formulae (N-I) and (N-II) described therein are preferably employed.

Specific examples of the compounds represented by the general formula (N-I) are set forth below, but the present invention is not to be construed as being limited to these compounds.

(N-I-1): 5-ethoxy-2-methyl-1-propargylquinolinium bromide
(N-I-2): 2,4-dimethyl-1-propargylquinolinium bromide
(N-I-3): 2-methyl-1-{3-[2-(4-methylphenyl)pyrazono]-butyl}quinolinium iodide
(N-I-4): 3,4-dimethyl-dihydropyrido[2,1-b]benzothiazolium bromide
(N-I-5): 6-ethoxythiocarbonylamino-2-methyl-1-propargylquinolium trifluoromethanesulfonate
(N-I-6): 2-methyl-6-(3-phenylthioureido)-1-propargylquinolinium bromide
(N-I-7) 6-(5-benzotriazolecarboxyamido)-2-methyl-1-propargylquinolinium trifluoromethanesulfate
(N-I-8): 6-[3-(2-mercaptoethyl)ureido]-2-methyl-1-propargylquinolinium trifluoromethanesulfonate
(N-I-9): 6-{3-[3-(5-mercapto-1,3,4-thiadiazol-1-ylthio)-propyl]ureido}-2-methyl-1-propargylquinolinium trifluoromethanesulfonate
(N-I-10): 6-(5-mercaptotetrazol-1-yl)-2-methyl-1-propargylquinolinium iodide
(N-I-11): 1-propargyl-2-(1-propenyl)quinolinium trifluoromethanesulfonate
(N-I-12): 6-ethoxythiocarbonylamino-2-(2-methyl-1-propenyl)-1-propargylquinolinium trifluoromethanesulfonate
(N-I-13): 10-propargyl-1,2,3,4-tetrahydroacridinium trifluoromethanesulfonate
(N-I-14): 7-ethoxythiocarbonylamino-10-propargyl 1,2,3,4-tetrahydroacridinium trifluoromethanesulfonate
(N-I-15): 6-ethoxythiocarbonylamino-1-propargyl-2,3-pentamethylenequinolinium trifluoromethanesulfonate
(N-I-16): 7-[3-(5-mercaptotetrazol-1-yl)benzamido]-10-propargyl-1,2,3,4-tetrahydroacridinium perchlorate
(N-I-17): 6-[3-(5-mercaptotetrazol-1-yl)benzamido]-1-propargyl-2,3-pentamethylenequinolinium bromide
(N-I-18): 7-(5-mercaptotetrazol-1-yl)-9-methyl-10-propargyl-1,2,3,4-tetrahydroacridinium bromide
(N-I-19): 7-[3-{N-[2-(5-mercapto-1,3,4-thiadiazol-2-yl)thioethyl]carbamoyl}propanamido]-10-propargyl-1,2,3,4-tetrahydroacridinium tetrafluoroborate
(N-I-20): 6-(5-mercaptotetrazol-1-yl)-4-methyl-1-propargyl-2,3-pentamethylenequinolinium bromide
(N-I-21): 7-ethoxythiocarbonylamino-10-propargyl-1,2-dihydroacridinium trifluoromethanesulfonate
(N-I-22): 7-(5-mercaptotetrazol-1-yl)-9-methyl-10-propargyl-1,2-dihydroacridinium hexafluorophosphate
(N-I-23): 7-[3-(5-mercaptotetrazol-1-yl)benzamido]-10-propargyl-1,2-dihydroacridinium bromide Specific examples of the compounds represented by the general formula (N-II) are set forth below, but the present invention is not to be construed as being limited to these compounds.

(N-II-1): 1-formyl-2-{4-[3-(2-methoxyphenyl)ureido]-phenyl}hydrazine
(N-II-2): 1-formyl 2-{4-[3-{3-[3-(2,4-di-tert-pentyl phenoxy)propyl]ureido}phenylsulfonylamino]-phenyl} hydrazine
(N-II-3): 1-formyl-2-{4-[3-(5-mercaptotetrazol-1-yl)-benzamido]phenyl}hydrazine
(N-II-4): 1-formyl-2-[4-{3-[3-(5-mercaptotetrazol-1-yl)phenyl]ureido}phenyl]hydrazine
(N-II-5): 1-formyl-2-[4-{3-[N-(5-mercapto-4-methyl-1,2,4-triazol-3-yl)carbamoyl]propanamido}-phenyl]-hydrazine
(N-II-6): 1-formyl-2-{4-[3-{N-[4-(3-mercapto-1,2,4-triazol-4-yl)phenyl]carbamoyl}propanamido]-phenyl}hydrazine
(N-II-7): 1-formyl-2-[4-{3-[N-(5-mercapto-1,3,4-thiadiazole-2-yl)carbamoyl]propanamido}-phenyl]-hydrazine
(N-II-8): 2-[4-(benzotriazol-5-carboxamido)phenyl]-1-formylhydrazine
(N-II-9): 2-[4-{3-[N-(benzotriazol-5-carboxamido)-carbamoyl]propanamido}phenyl]-1-formylhydrazine
(N-II-10): 1-formyl-2-{4-[1-(N-phenylcarbamoyl)thiosemicarbazido]phenyl}hydrazine (N-II-11): 1-formyl-2-{4-[3-(phenylthioureido)benzamido]phenyl]-hydrazine
(N-II-12): 1-formyl-2-{4-(3-hexylureido)phenyl]-hydrazine
(N-II-13): 1-formyl-2-{4-[3-(5-mercaptotetrazol-1-yl)-benzenesulfonamido]phenyl}hydrazine
(N-II-14): 1-formyl-2-{4-[3-{3-[3-(5-mercaptotetrazol-1-yl)phenyl]ureido}benzenesulfonamido]-phenyl}hydrazine Nucleation accelerating agents which can be used in the present invention include tetraazaindenes, triazaindenes and pentaazaindenes having at least one mercapto group that may be optionally substituted with an alkali metal atom or an ammonium group, and compounds as described in JP-A-61-136948 (pages 2 to 6 and 16 to 43) and Japanese patent application Nos. 61-136949 (pages 12 to 43) and 61-15348 (pages 10 to 29).

Specific examples of suitable nucleation accelerating agents are illustrated below, but the present invention is not to be construed as being limited to these compounds.

(A-1): 3-mercapto-1,2,4-triazolo[4,5-a]pyridine
(A-2): 2-mercapto-1,2,4-triazolo[4,5-a]pyrimidine
(A-3): 5-mercapto-1,2,4-triazolo[1,5-a]pyrimidine
(A-4): 7-(2-dimethylaminoethyl)-5-mercapto-1,2,4-triazolo[1,5-a]pyrimidine
(A-5): 3-mercapto-7-methyl-1,2,4-triazolo[4,5-a]pyridazine
(A-6): 3,6-dimercapto-1,2,4-triazolo[4,5-b]pyridazine
(A-7): 2-mercapto-5-methylthio-1,3,4-thiadiazole
(A-8): 3-mercapto-4-methyl-1,2,4-triazole
(A-9) 2-(3-dimethylaminopropylthio)-5-mercapto-1,3,4-thiadiazole hydrochloride
(A-10): 2-(3-morpholinoethylthio)-5-mercapto-1,3,4-thiadiazole hydrochloride
(A-11): 2-mercapto-5-methylthiomethylthio-1,3,4-thiadiazole sodium salt
(A-12): 4-(2-morpholinoethyl)-3-mercapto-1,2,4-triazole (A-13): 1-[2-(2-dimethylaminoethylthio)ethylthio]-5-mercapto-1,3,4-thiadiazole hydrochloride (A-14): 2-(6-dimethylaminohexylthio)-5-mercapto-1,3,4-thiadiazole hydrochloride (A-15): 2-{3-[2-methyl-1-(1,4,5,6-tetrahydropyrimidinyl)]propylthio}-5-mercapto-1,3,4-thiadiazole hydrochloride A color developing solution which can be used in development processing of the color photographic light-sensitive material according to the present invention is an alkaline aqueous solution containing an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-8-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, or p-toluenesulfonates thereof, etc.

Two or more kinds of color developing agents may be employed in combination, depending on the purpose.

The color developing solution ordinarily contains pH buffering agents, such as carbonates, borates or phosphates of alkali metals, etc.; and development inhibitors or anti-fogging agents such as bromides, iodides, benzimidazoles, benzothiazoles, or mercapto compounds, etc. Further, if necessary, the color developing solution may contain various preservatives such as, hydroxylamine, diethylhydroxylamine, sulfites, hydrazines, phenylsemicarbazides, triethanolamine, catechol sulfonic acids, triethylenediamine(1,4-diazabicyclo[2,2,2]octane), etc.; organic solvents such as ethylene glycol, diethylene glycol, etc.; development accelerators such as benzyl alcohol, polyethylene glycol, quarternary ammonium salts, amines, etc.; dye forming couplers; competing couplers; fogging agents such as sodium borohydride, etc.; auxiliary developing agents such as 1-phenyl-3-pyrazolidone, etc.; viscosity imparting agents; and various chelating agents represented by aminopolycarboxylic acids, aminopolyphosphonic acids, alkylphosphonic acids, phosphonocarboxylic acids, etc. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(p-hydroxyphenylacetic acid), and salts thereof.

The pH of the color developing solution used is ordinarily in a range from 9 to 12, preferably in a range from 9.5 to 11.5. Further, an amount of replenishment for the developing solution can be varied depending on the color photographic light-sensitive material to be processed, but is generally not more than 1 liter per square meter of the photographic light-sensitive material. The amount of replenishment can be reduced to not more than 300 ml by decreasing the bromide ion concentration in the replenisher. In the case of reducing the amount of replenishment, it is preferred to prevent evaporation and aerial oxidation of the processing solution by means of reducing an area of a processing tank which is contact with the air. Further, the amount of replenishment can be reduced using a means which restrains accumulation of bromide ion in the developing solution.

After color development, the photographic materials is usually subjected to bleach processing. The bleach processing step can be performed simultaneously with fix processing (bleach-fix processing), or it can be performed independently from the fix processing step. Further, for the purpose of performing rapid processing, a processing method wherein after bleach processing, bleach-fix processing is conducted may be employed. Moreover, depending on the purpose, a continuous two tank bleach-fixing bath may be used, fix processing may be carried out before bleach-fix processing, or bleach processing may be conducted after bleach-fix processing.

Examples of bleaching agents which can be employed in the bleach processing step or bleach-fix processing step include compounds of a multivalent metal such as iron(III), cobalt(III), chromium(VI), copper(II), etc.; peracids; quinones; nitro compounds; etc. Representative examples of the bleaching agents include ferricyanides; dichloromates; organic complex salts of iron(III) or cobalt(III), for example, complex salts of aminopolycarboxylic acids (such as ethylenediamine-tetraacetic acid, diethylenetriaminepentaacetic acid , cyclohexanediaminetetraacetic acid, methyliminodiacetic acid, 1,3-diaminopropanetetraacetic acid, glycol ether diaminetetraacetic acid, etc.), or complex salts of organic acids (such as citric acid, tartaric acid, malic acid, etc.); persulfates; bromates; permanganates; nitrobenzenes; etc. Of these compounds, iron(III) complex salts of aminopolycarboxylic acids represented by iron(III) complex salts of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, however, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described in U.S. Pat. No. 3,893,858, West German Pat. No. 1,290,812, JP-A-53-95630, *Research Disclosure,* No. 17129 (July 1978), etc.; thiazolidine derivatives as described in JP-A-50-140129, etc.; thiourea derivatives as described in U.S. Pat. No. 3,706,561, etc.; iodides as described in JP-A-58-16235, etc.; polyoxyethylene compounds as described in West German Pat. No. 2,748,430, etc.; polyamine compounds as described in JP-B-45-8836, etc.; and bromide ions. Of these compounds, the compounds having a mercapto group or a disulfide bond are preferred in view of their large bleach accelerating effects. Particularly, the compounds as described in U.S. Pat. No. 3,893,858, West German Pat. No. 1,290,812 and JP-A-5395630 are preferred. Further, the compounds as described in U.S. Pat. No. 4,552,834 are also preferred. These bleach accelerating agents may also be incorporated into the color photographic light-sensitive material. These bleach accelerating agents are particularly effectively employed when color photographic light-sensitive materials for photographing are subjected to bleach-fix processing.

Suitable fixing agents which can be employed in the fixing solution or bleach-fixing solution include thiosulfates, thiocyanate, thioether compounds, thioureas, a large amount of iodide, etc. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on characteristics of photographic light-sensitive materials (due to elements used therein, for example, couplers, etc.), uses thereof, temperature of washing water, the number of water washing tanks (stages), the replenishment system such as countercurrent or orderly current, etc., or other various conditions. The relationship between the number of water washing tanks and the amount of water in a multistage countercurrent system can be determined based on the method as described in *Journal of the Society of Motion Picture and Television Enqineers,* Vol. 64, pages 248 to 253 (May, 1955).

According to the multi-stage countercurrent system described in the above literature, the amount of water for washing can be significantly reduced. However, increase in staying time of water in a tank causes propagation of bacteria and some problems such as adhesion of floatage formed on the photographic materials, etc. occur. In the method of processing the silver halide color photographic material according to the present invention, a method for reducing amounts of calcium ions and magnesium ions as described in Japanese patent application No. 61-131632 can be particularly effectively employed in order to solve such problems. Further, sterilizers, for example, isothiazolone compounds as described in JP-A-57-8542, thiabendazoles, chlorine type sterilizers such as sodium chloroisocyanurate, etc., benzotriazoles, sterilizers as described in Hiroshi Horiguchi, *Bokin-Bobai No Kaqaku, Biseibutsu No Mekkin-, Sakkin-, Bobai-Gijutsu,* edited by Eiseigijutsu Kai, *Bokin-Bobaizai Jiten,* edited by Nippon Bokin-Bobai Gakkai, etc. can be employed.

The pH of the washing water used in the processing of the photographic light-sensitive material according to the present invention is usually from 4 to 9, preferably from 5 to 8. The temperature of washing water and time for the water washing step can be variously set depending on characteristics or uses of photographic light-sensitive materials, etc. However, it is common to select a range of from 15° C. to 45° C. and a period from 20 sec. to 10 min. and preferably a range of from 25° C. to 40° C. and a period from 30 sec. to 5 min.

The photographic light-sensitive material according to the present invention can also be directly processed with a stabilizing solution in place of the above-described water washing step. In such a stabilizing process, any of known methods as described, for example, in JP-A-57-8543, JP-A-58-14834 and JP-A-60-220345 can be employed. To such a stabilizing bath, various chelating agents and antimold agents may also be added.

Overflow solutions resulting from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. No. 3,342,597, Schiff's base type compounds as described in U.S. Pat. No. 3,342,599, and *Research Disclosure,* No. 14850 and ibid., No. 15159, aldol compounds as described in *Research Disclosure,* No. 13924, metal salt complexes as described in U.S. Pat. No. 3,719,492, urethane type compounds as described in JP-A-53-135628, etc.

Further, the silver halide color photographic material according to the present invention may contain, if desired, various 1-phenyl-3-pyrazolidones for the purpose of accelerating color development. Typical examples of these compounds include those as described, for example, in JP-A-56-64339, JP-A-57-144547, and JP-A-58-115438.

In the present invention, various kinds of processing solutions can be employed within a temperature range from 10° C. to 50° C. Although a standard temperature is from 33° C. to 38° C, it is possible to carry out the processing at higher temperatures in order to accelerate the processing whereby the processing time is shortened, or at lower temperatures in order to achieve improvement in image quality and to maintain stability of the processing solutions.

Further, for the purpose of conserving the amount of silver employed in the color photographic light-sensitive material, the photographic processing may be conducted utilizing color intensification using cobalt or hydrogen peroxide as described in West German Pat. No. 2,226,770 or U.S. Pat. No. 3,674,499.

It is preferred that the amount of the replenisher is small in each processing step. The amount of the replenisher is preferably from 0.1 to 50 times, more preferably from 3 to 30 times the amount of the solution carried over from the preceding bath per unit area of the photographic light-sensitive material.

The present invention is now illustrated in greater detail with reference to the following Examples, but the present invention is not to be construed as being limited thereto. Unless otherwise indicated, all parts, percents and ratios are by weight.

EXAMPLE 1

The following First layer to Fourteenth layer were coated on the front side of a paper support (having a thickness of 100 mμ, both surfaces of which were laminated with polyethylene, and the following Fifteenth layer to Sixteenth layer were coated on the back side of the paper support to prepare a color photographic light-sensitive material. The polyethylene laminated on the First layer side of the support contained titanium dioxide as a white pigment and a small amount of ultramarine as a bluish dye.

Construction of Layers

The composition of each layer is shown below. The coating amounts of the components are described in the unit of g/m$^2$. With respect to silver halide and colloidal silver, the coating amount is indicated in terms of a silver coating amount. The emulsion used in each layer was prepared according to the method for preparation of Emulsion EMl. The emulsion used in the Fourteenth layer was a Lippmann emulsion not being chemically sensitized on the surfaces of grains.

| | |
|---|---|
| First Layer: Antihalation Layer | |
| Black colloidal silver | 0.10 |
| Gelatin | 1.30 |
| Second Layer: Intermediate Layer | |
| Gelatin | 0.70 |
| Third Layer: Low-Sensitive Red-Sensitive Layer | |
| Silver bromide emulsion spectrally sensitized with Red-sensitizing dyes (ExS-1,2,3 mixing ratio: 5/4.5/0.5) (average grain size: 0.3 μm, size distribution (coefficient of variation): 8%, octahedral) | 0.06 |
| Silver chlorobromide emulsion spectrally sensitized with Red-sensitizing dyes (ExS-1,2,3 mixing ratio: 5/4.5/0.5) (silver chloride: 5 mol %, average grain size: 0.45 μm, size distribution: 10%, octahedral) | 0.10 |
| Gelatin | 1.00 |
| Cyan coupler (ExC-1) | 0.11 |
| Cyan coupler (ExC-2) | 0.10 |
| Color fading preventing agent (Cpd-2, 3, 4, 13, mixing ratio: 1/1/1/1) | 0.12 |
| Coupler dispersing medium (Cpd-5) | 0.03 |
| Coupler solvent (Solv-7, 2, 3, mixing ratio: 1/1/1) | 0.06 |
| Fourth Layer: High-Sensitive Red-Sensitive Layer | |
| Silver bromide emulsion spectrally sensitized with Red-sensitizing dyes (ExS-1,2,3 mixing ratio: 5/4.5/0.5) (average grain size: 0.60 μm, size distribution: 15%, octahedral) | 0.14 |
| Gelatin | 1.00 |
| Cyan coupler (ExC-1) | 0.15 |
| Cyan coupler (ExC-2) | 0.15 |
| Color fading preventing agent (Cpd-2, 3, 4, 13, mixing ratio: 1/1/1/1) | 0.15 |
| Coupler dispersing medium (Cpd-5) | 0.03 |
| Coupler solvent (Solv-7, 2, 3, mixing ratio: 1/1/1) | 0.10 |
| Fifth Layer: Intermediate Layer | |
| Gelatin | 1.00 |
| Color mixing preventing agent (Cpd-7) | 0.08 |
| Color mixing preventing agent solvent (Solv-4, 5, mixing ratio: 1/1) | 0.16 |
| Polymer latex (Cpd-8) | 0.10 |
| Sixth Layer: Low-Sensitive Green-Sensitive Layer | |
| Silver bromide emulsion spectrally sensitized with Green-sensitizing dyes (ExS-3)(average grain size: 0.25 μm, size distribution: 8%, octahedral) | 0.04 |
| Silver bromide emulsion spectrally sensitized with Green-sensitizing dyes (ExS-4)(average grain size: 0.45 μm, size distribution: 11%, octahedral) | 0.06 |
| Gelatin | 0.80 |
| Magenta coupler (ExM-1, 2, mixing ratio: 1/1) | 0.11 |
| Color fading preventing agent (Cpd-9) | 0.10 |
| Stain preventing agent (Cpd-10, 22, mixing ratio: 1/1) | 0.014 |
| Stain preventing agent (Cpd-23) | 0.001 |
| Stain preventing agent (Cpd-12) | 0.01 |
| Coupler dispersing medium (Cpd-5) | 0.05 |
| Coupler solvent (Solv-4, 6, mixing ratio: 1/1) | 0.15 |
| Seventh Layer: High-Sensitive Green-Sensitive Layer | |
| Silver bromide emulsion spectrally sensitized with Green-sensitizing dye (ExS-3, 4)(average grain size: 0.8 μm, size distribution: 16%, octahedral) | 0.10 |
| Gelatin | 0.80 |
| Magenta coupler (ExM-1, 2, mixing raio: 1/1) | 0.11 |

-continued

| | |
|---|---|
| Color fading preventing agent (Cpd-9) | 0.10 |
| Stain preventing agent (Cpd-10, 22, mixing ratio: 1/1) | 0.013 |
| Stain preventing agent (Cpd-23) | 0.001 |
| Stain preventing agent (Cpd-12) | 0.01 |
| Coupler dispersing medium (Cpd-5) | 0.05 |
| Coupler solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow colloidal silver | 0.20 |
| Gelatin | 1.00 |
| Color mixing preventing agent (Cpd-7) | 0.06 |
| Color mixing preventing agent solvent (Solv-4, 5, mixing ratio: 1/1) | 0.15 |
| Polymer latex (Cpd-8) | 0.10 |
| Tenth Layer: Intermediate Layer | |
| Same as Fifth Layer | |
| Eleventh Layer: Low-Sensitive Blue-Sensitive Layer | |
| Silver bromide emulsion spectrally sensitized with Blue-sensitizing dye (ExS-5,6, mixing ratio: 1:1) (average grain size: 0.45 μm, size distribution: 8%, octahedral) | 0.07 |
| Silver bromide emulsion spectrally sensitized with Blue-sensitizing dye (ExS-5,6, mixing ratio: 1:1) (average grain size: 0.60 μm, size distribution: 14%, octahedral) | 0.10 |
| Gelatin | 0.50 |
| Yellow coupler (ExY-1) | 0.22 |
| Stain preventing agent (Cpd-11) | 0.001 |
| Color fading preventing agent (Cpd-6) | 0.1 |
| Coupler dispersing medium (Cpd-5) | 0.05 |
| Coupler solvent (Solv-2) | 0.05 |
| Twelfth Layer: High-Sensitive Blue-Sensitive Layer | |
| Silver bromide emulsion spectrally sensitized with Blue-sensitizing dyes (ExS-5,6, mixing ratio: 1:1) (average grain size: 1.2 μm, size distribution: 21%, octahedral) | 0.25 |
| Gelatin | 1.00 |
| Yellow coupler (ExY-1) | 0.41 |
| Stain preventing agent (Cpd-11) | 0.002 |
| Color fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Light Absorbing Layer | |
| Gelatin | 1.50 |
| Ultraviolet light absorbing agent (Cpd-1, 3, 13, mixing ratio: 1/1/1) | 1.00 |
| Color mixing preventing agent (Cpd-6, 14, mixing ratio: 1/1) | 0.06 |
| Dispersing medium (Cpd-5) | 0.05 |
| Ultraviolet light absorbing agent solvent (Solv-1, 2, mixing ratio: 1/1) | 0.15 |
| Irradiation preventing dye (Cpd-15, 16, mixing ratio: 1/1) | 0.02 |
| Irradiation preventing dye (Cpd-17, 18, mixing ratio: 1/1) | 0.02 |
| Fourteenth Layer: Protective Layer | |
| Silver chlorobromide fine particles (silver chloride: 97 mol %, average grain size: 0.2 μm) | 0.05 |
| Acryl-modified copolymer of polyvinyl alcohol (degree of modification: 17%) | 0.02 |
| Polymethyl methacrylate particles (average particle size: 2.4 μm) and silicon oxide (average particle size: 5 μm), mixing ratio: 1/1 | 0.05 |
| Gelatin | 1.50 |
| Gelatin hardener (H-1) | 0.17 |
| Fifteenth Layer: Back Layer | |
| Gelatin | 2.50 |
| Sixteenth Layer: Back protective Layer | |
| Polymethyl methacrylate particles (average particle size: 2.4 μm) and silicon oxide (average particle | 0.05 |

-continued

| | |
|---|---|
| size: 5 μm), mixing ratio: 1/1 | |
| Gelatin | 2.00 |
| Gelatin hardener (H-1) | 0.11 |

Preparation of Emulsion EM-1

An aqueous solution of potassium bromide and an aqueous solution of silver nitrate were added simultaneously to an aqueous gelatin solution at 75° C. over 15 minutes while vigorously stirring, to obtain an octahedral silver bromide emulsion having an average grain diameter of 0.40 μm. 0.1 g of 3,4-dimethyl-1,3-thiazoline-2-thione, 8 mg of sodium thiosulfate and 10 mg of chloroauric acid (tetrahydrate) were added to the emulsion per mol of silver in order and the emulsion was heated to 75° C. for 25 minutes to be chemically sensitized. The thus prepared silver bromide grains were used as cores and were further grown under the same precipitation conditions as above to finally obtain a monodispersed octahedral core/shell type silver bromide emulsion having an average grain diameter of 0.7 μm. The coefficient of variation of the grain size was about 10%.

1.5 mg of sodium thiosulfate and 1.8 mg of chloroauric acid (tetrahydrate) were added to the emulsion per mol of silver, and the emulsion was heated to 60° C. for 45 minutes to be chemically sensitized. Thus an internal latent image type silver halide emulsion was obtained.

To each light-sensitive layer, ExZK-1 as a nucleating agent in an amount of $1\times10^{-3}$ % by weight per the coating amount of silver halide and Cpd-24 as a nucleation accelerating agent in an amount of $1\times10^{-2}$ % by weight per the coating amount of silver halide.

To each layer, as emulsifying dispersing aids, Alkanol XC (manufactured by E.I. Du Pont de Nemours & Co.) and sodium alkylbenzenesulfonate, and as coating aids, succinic acid ester and Megafac F-120 (manufactured by Dai Nippon Ink and Chemical Co., Ltd.) were added. Furthermore, to the layers containing silver halide or colloidal silver, Stabilizers (Cpd-19, 20, 21) were added. Thus-obtained photographic light-sensitive material was designated Sample 12.

The compounds used in various layers of the photographic material of this Example are illustrated below.

ExS-1

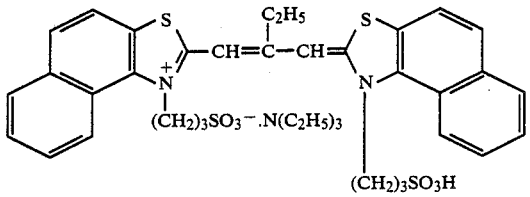

ExS-2

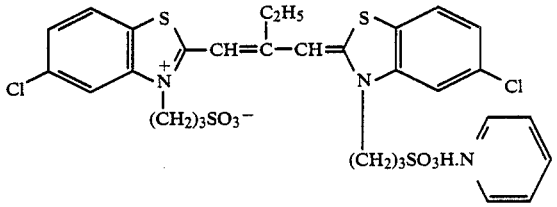

ExS-3

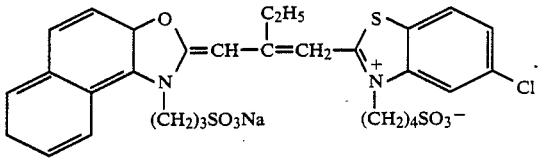

ExS-4

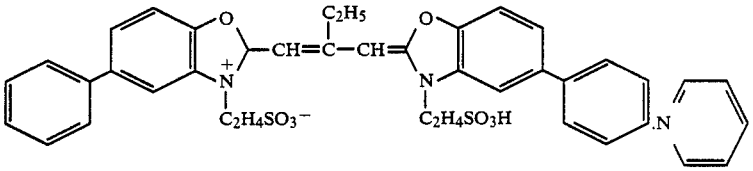

ExS-5

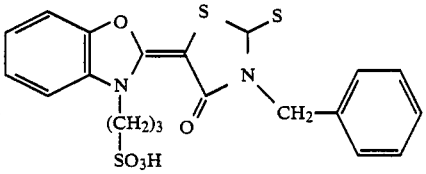

-continued
ExS-6
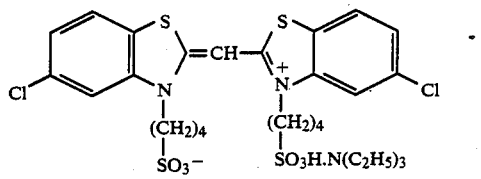
Cpd-1
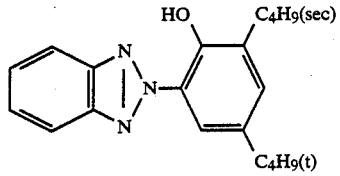
Cpd-2
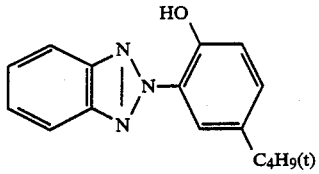
Cpd-3
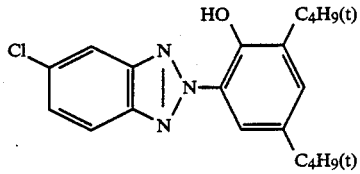
Cpd-4
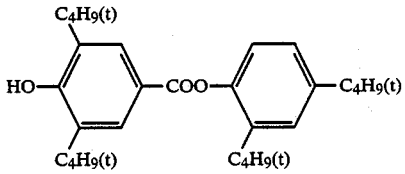
Cpd-5
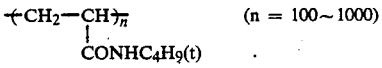
Cpd-6
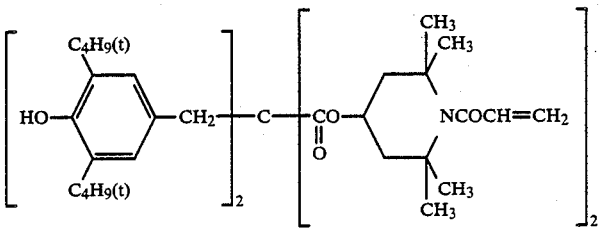
Cpd-7
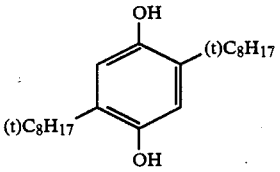
Polyethyl acrylate Cpd-8

-continued
Cpd-9
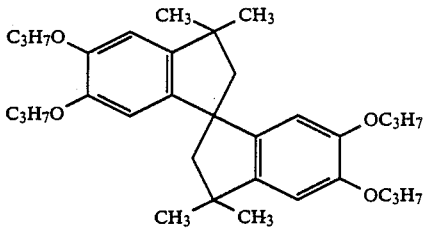
Cpd-10
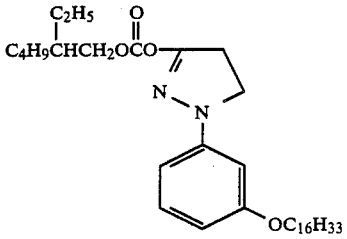
Cpd-11
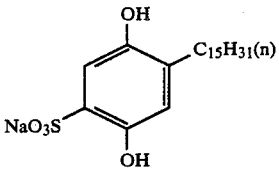
Cpd-12
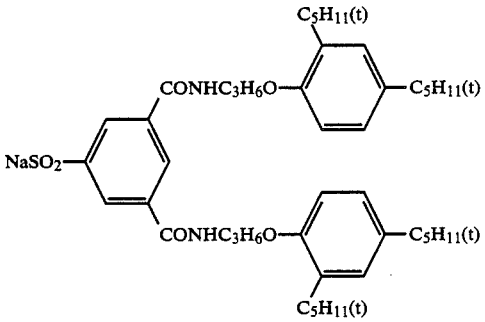
Cpd-13
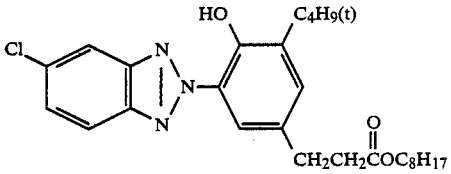
Cpd-14
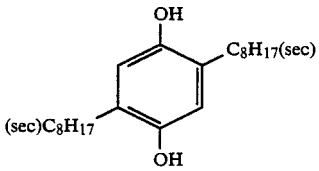
Cpd-15
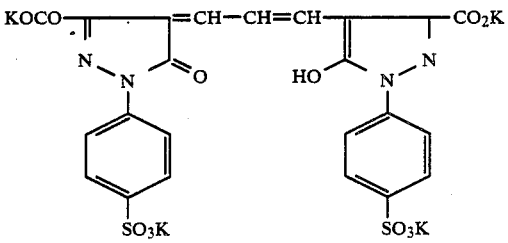

-continued
Cpd-16
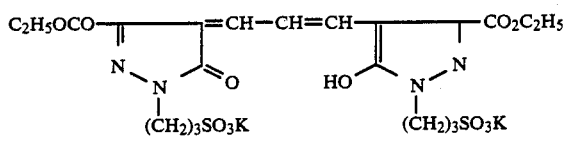
Cpd-17
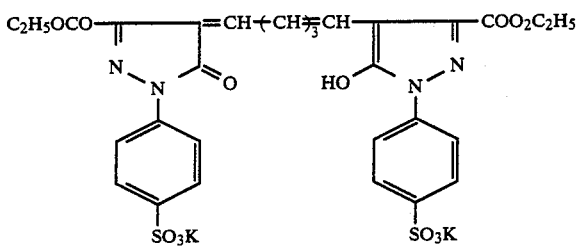
Cpd-18
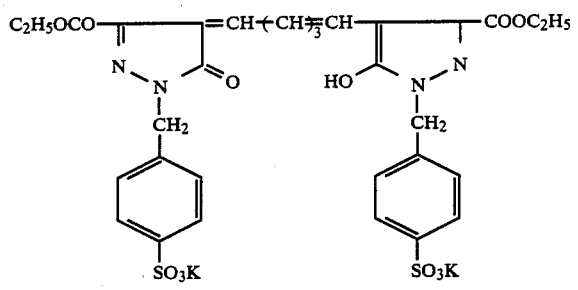
Cpd-19
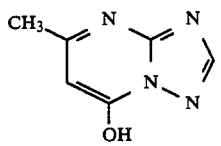
Cpd-20
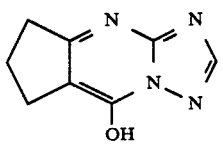
Cpd-21
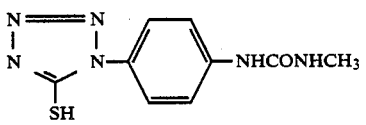
Cpd-22
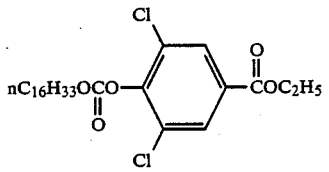
Cpd-23
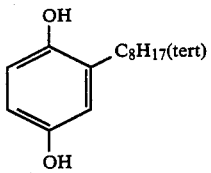
Cpd-24
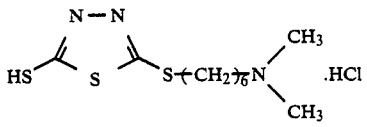

-continued

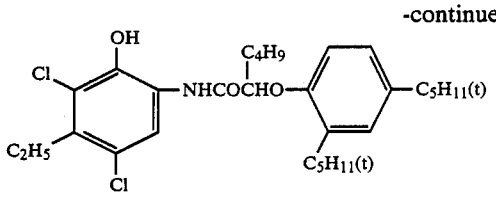

ExC-1

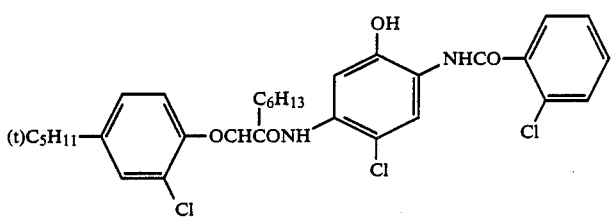

ExC-2

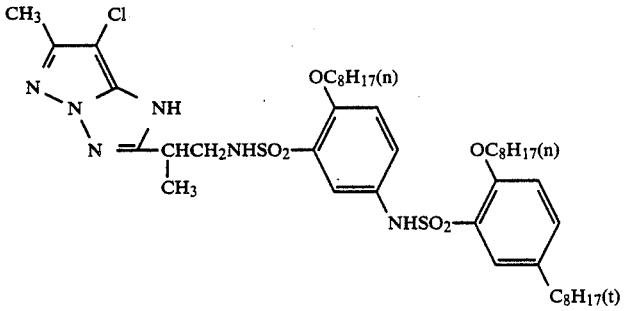

ExM-1

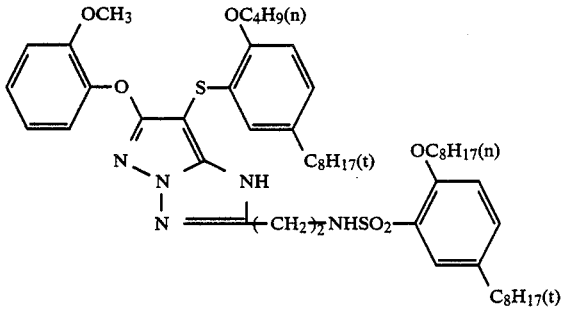

ExM-2

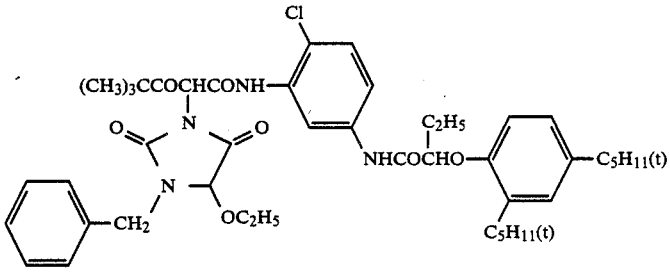

ExY-1

| | |
|---|---|
| Di(2-ethylhexyl)phthalate | Solv-1 |
| Trinonylphosphate | Solv-2 |
| Di(3-methylhexyl)phthalate | Solv-3 |
| Tricresylphosphate | Solv-4 |
| Dibutylphthalate | Solv-5 |
| Trioctylphosphate | Solv-6 |
| Di(2-ethylhexyl)sebacate | Solv-7 |
| 1,2-Bis(vinylsulfonylacetamido)ethane | H-1 |
| 1-[3-(5-Mercaptotetrazol-1-yl)benzamido]-10-propargyl-1,2,3,4-tetrahydroacridinium | ExZK-1 perchlorate |

Further, direct positive photographic materials designated Sample Nos. 1 to 11 were prepared in the same manner as described for Sample No. 12 above for comparison, except that the sensitivity dyes represented by general formula (I) according to the present invention were added to the sixth layer and the seventh layer as shown in Table 1 below and that the ninth layer was eliminated as shown in Table 1 below.

These samples were exposed to light so as to make a development rate of 60%, and then subjected to running processing according to Processing Method A described below using an automatic developing machine with a color developing tank of 8 liters, a bleach-fixing tank of 4 liters, washing with water tanks (1) and (2) of 4 liters respectively, and washing with water tank (3) of 0.5 liters in the total amount of 20 $m^2$.

Each of the above described samples was subjected to wedge-exposure (0.1 second, 10 CMS, using a halogen lamp at 3200° K.) and then development processing according to Processing Method A using the following processing solutions after the above described running processing.

Processing Method A:

| Processing Step | Time | Temperature (°C.) | Amount of Replenishment ($ml/m^2$) |
|---|---|---|---|
| Color development | 1 min 30 sec | 38 | 300 |
| Bleach-Fixing | 40 sec | 35 | 300 |
| Washing with Water (1) | 40 sec | 30 to 36 | |
| Washing with Water (2) | 40 sec | 30 to 36 | |
| Washing with Water (3) | 15 sec | 25 to 36 | 320 |
| Drying | 30 sec | 75 to 80 | |

The replenishment of washing water was conducted using a so-called countercurrent system, wherein a replenisher was supplied to the water washing bath (3), the solution overflown from the water washing bath (3) was introduced into the water washing bath (2), and the solution overflown from the water washing bath (2) was introduced into the water washing bath (1) The amount of the processing solution carried over from the previous bath together with the photographic material being processed was 35 $ml/m^2$ and thus a replenishment magnification to washing water was 9.1 times.

The compositions of the processing solutions used were as follows.

| Color Developing Solution | Tank | Replenisher |
|---|---|---|
| Ethylenediaminetetramethylenephosphonic acid | 0.5 g | 0.5 g |
| Diethylene glycol | 8.0 g | 13.0 g |
| Benzyl alcohol | 12.0 g | 18.5 g |
| Sodium bromide | 0.6 g | — |
| Sodium chloride | 0.5 g | — |
| Sodium sulfite | 2.0 g | 2.5 g |
| N,N-Diethylhydroxylamine | 3.5 g | 4.5 g |
| Triethylenediamine (1,4-diazabicyclo[2,2,2]octane) | 3.5 g | 4.5 g |
| 3-Methyl-4-amino-N-ethyl N-(β-methanesulfonamidoethyl)aniline sulfate | 5.5 g | 8.0 g |
| Potassium carbonate | 30.0 g | 30.0 g |
| Fluorescent whitening agent (stilbene type) | 1.0 g | 1.3 g |
| Pure water to make | 1,000 ml | 1,000 ml |
| pH | 10.50 | 10.90 |

pH was adjusted with potassium hydroxide or hydrochloric acid.

| Bleach-Fixing Solution | (Both Tank and Replenisher) |
|---|---|
| Ammonium thiosulfate | 100 g |
| Sodium hydrogensulfite | 21.0 g |
| Ammonium iron (III) ethylenediaminetetraacetate dihydrate | 50.0 g |
| Disodium ethylenediaminetetraacetate dihydrate | 5.0 g |
| Pure water to make | 1,000 ml |
| pH | 6.3 |

pH was adjusted with aqueous ammonia or hydrochloric acid.

Washing Water

Pure water was used (both Tank and Replenisher).

The pure water used herein was prepared by conducting ion exchange treatment of city (tap) water to reduce total cations other than hydrogen ion and total anions other than hydroxy ions to a level of not more than 1 ppm.

With the samples thus processed, density of magenta color image obtained was measured. The results are shown in Table 1 below.

TABLE 1

| Sample No. | Sensitizing* Dye | Ninth Layer | $D_{max}$ | $D_{min}$ | Relative Sensitivity of Re-reversal Negative Image |
|---|---|---|---|---|---|
| 1 | 54 | present | 2.4 | 0.11 | 5 |
| 2 | 55 | " | 2.4 | 0.11 | 5 |
| 3 | 20 | " | 2.4 | 0.11 | 5 |
| 4 | 24 | " | 2.4 | 0.11 | 4 |
| 5 | 16 | " | 2.4 | 0.11 | 4 |
| 6 | 54 | none | 2.1 | 0.11 | 10 |
| 7 | 55 | " | 2.1 | 0.11 | 10 |
| 8 | 20 | " | 2.0 | 0.11 | 8 |
| 9 | 24 | " | 2.1 | 0.11 | 10 |
| 10 | 16 | " | 2.1 | 0.11 | 8 |
| 11 | — | " | 1.8 | 0.14 | 100 (standard) |
| 12 | — | present | 2.1 | 0.15 | 80 |

*Amount added: $1.5 \times 10^{-4}$ mol/mol silver

As is apparent from the results shown in Table 1, Samples Nos. 1 to 5 containing the sensitizing dye and the colloidal silver containing layer according to the present invention are preferred in view of high $D_{max}$ and low sensitivity of re-reversal negative image in comparison with Comparative Sample Nos. 6 to 10. Further, as compared with Comparative Sample Nos. 11 and 12, they are preferred because of high $D_{max}$, low $D_{min}$ and low sensitivity of re-reversal negative image.

EXAMPLE 2

The same procedure as described in Example 1 was repeated except for using Processing Method B described below in place of Processing Method A. Almost the same results as those in Example 1 were obtained.

Processing Method B:

| Processing Step | Time (sec) | Temperature (°C.) | Amount of Replenishment ($ml/m^2$) |
|---|---|---|---|
| Color development | 70 | 38 | 260 |
| Bleach-Fixing | 30 | 38 | 260 |
| Washing with Water (1) | 30 | 38 | |
| Washing with Water (2) | 30 | 38 | 300 |

In the water washing steps, the replenishment magnification of washing water was 8.6 times.

The compositions of the processing solutions used were as follows.

| Color Developing Solution | Tank | Replenisher |
|---|---|---|
| Diethylenetriaminepenta-acetic acid | 0.5 g | 0.5 g |
| 1-Hydroxyethylidene-1,1-diphosphonic acid | 0.5 g | 0.5 g |
| Diethylene glycol | 8.0 g | 10.7 g |
| Benzyl alcohol | 9.0 g | 12.0 g |
| Sodium bromide | 0.7 g | — |
| Sodium chloride | 0.5 g | — |
| Sodium sulfite | 2.0 g | 2.4 g |
| Hydroxylamine sulfate | 2.8 g | 3.5 g |
| 3-Methyl-4-amino-N-ethyl-N-(β-methanesulfonamidoethyl) aniline sulfate | 2.0 g | 2.5 g |
| 3-Methyl-4-amino-N-ethyl-N-(β-hydroxylethyl)aniline sulfate | 4.0 g | 4.5 g |
| Potassium carbonate | 30.0 g | 30.0 g |
| Fluorescent whitening agent (stilbene type) | 1.0 g | 1.2 g |
| Pure water to make | 1,000 ml | 1,000 ml |
| pH | 10.50 | 10.90 |

pH was adjusted with potassium hydroxide or hydrochloric acid.

| Bleach-Fixing Solution | Tank | Replenisher |
|---|---|---|
| Ammonium thiosulfate | 77.0 g | 100.0 g |
| Sodium hydrogensulfite | 14.0 g | 21.0 g |
| Ammonium iron (III) ethylenediaminetetra-acetate dihydrate | 40.0 g | 53.0 g |
| Disodium ethylenediamine-acetate dihydrate | 4.0 g | 5.0 g |
| 2-Mercapto-1,3,4-triazole | 0.5 g | 0.5 g |
| Pure water to make | 1,000 ml | 1,000 ml |
| pH | 7.0 | 6.5 |

pH was adjusted with aqueous ammonia or hydrochloric acid.

Washing Water

Pure water was used (both Tank and Replenisher).

EXAMPLE 3

The same procedure as described in Example 1 was repeated except for using Emulsion EM-2 and an emulsion whose grain size was adjusted by decreasing the temperature at the formation of the silver halide grain, and Processing Method C described below. The results are shown in Table 2 below.

TABLE 2

| Sample No. | Sensitizing* Dye | Ninth Layer | $D_{max}$ | $D_{min}$ | Relative Sensitivity of Re-reversal Negative Image |
|---|---|---|---|---|---|
| 1 | 54 | present | 2.3 | 0.12 | 15 |
| 2 | 55 | " | 2.4 | 0.12 | 5 |
| 3 | 20 | " | 2.3 | 0.12 | 5 |
| 4 | 24 | " | 2.4 | 0.12 | 6 |
| 5 | 16 | " | 2.3 | 0.12 | 5 |
| 6 | 54 | none | 2.1 | 0.12 | 10 |
| 7 | 55 | " | 2.0 | 0.12 | 10 |
| 8 | 20 | " | 2.0 | 0.12 | 8 |
| 9 | 24 | " | 2.1 | 0.12 | 8 |
| 10 | 16 | " | 2.0 | 0.12 | 10 |
| 11 | — | " | 1.7 | 0.14 | 100 (standard) |
| 12 | — | present | 2.1 | 0.17 | 75 |

*Amount added: $1.5 \times 10^{-4}$ mol/mol silver

As is apparent from the results shown in Table 2, Sample Nos. 1 to 5 containing the sensitizing dye and the colloidal silver containing layer according to the present invention are preferred in view of high $D_{max}$ and low sensitivity of re-reversal negative image in comparison with Comparative Sample Nos. 6 to 10. Further, as compared with Comparative Sample Nos. 11 and 12, they are preferred because of high $D_{max}$, low $D_{min}$ and low sensitivity of re-reversal negative image.

The method of preparation of Emulsion EM-2 is shown below.

Preparation of Emulsion EM-2

An aqueous mixture solution containing potassium bromide and sodium chloride and an aqueous solution of silver nitrate were simultaneously added at 65° C. over a period of about 30 minutes with vigorous stirring to an aqueous gelatin solution containing 0.08 g of 3,4-dimethyl-1,3-thiazoline-2-thion per mol of Ag to obtain a monodispersed silver chlorobromide emulsion (silver bromide content: 30 mol%) having an average grain diameter of about 0.28 μm. 31 mg of sodium thiosulfate and 21 mg of chloroauric acid (tetrahydrate) were added to the emulsion per mol of silver and the emulsion was heated at 65° C. for 45 minutes to be chemically sensitized. The thus prepared silver chlorobromide grains were used as cores and were treated under the same precipitation conditions as above to be further grown thereby producing finally a monodispersed core/shell silver chlorobromide emulsion (silver bromide content: 30 mol%) having an average grain diameter of about 0.65 μm. The coefficient of variation on grain size was about 15%. To the emulsion were added 1.5 mg of sodium thiosulfate and 0.8 mg of chloroauric acid (tetrahydrate) per mol of silver, and the emulsion was heated at 60° C. for 40 minutes to be chemically sensitized thereby producing an internal latent image type silver halide emulsion EM-2. Processing Method C:

| Processing Step | Time | Temperature | Amount of Replenishment |
|---|---|---|---|
| Color development*1 | 90 sec | 36° C. | 320 ml/m² |
| Bleach-Fixing | 40 sec | 36° C. | 320 ml/m² |
| Stabilizing (1) | 40 sec | 36° C. | |
| Stabilizing (2) | 40 sec | 36° C. | 320 ml/m² |
| Drying | 40 sec | 76° C. | |

*1Light-Sensitive materials were immersed in the color developing solution for 15 seconds, then subjected to color development while being uniformly exposed to white light of 1 lux for 15 seconds.

The composition of each processing solution used was as follows.

| Color Developing Solution | Tank | Replenisher |
|---|---|---|
| Hydroxyethyliminodiacetic acid | 0.5 g | 0.5 g |
| β-Cyclodextrin | 1.5 g | 1.5 g |
| Monoethylene glycol | 9.0 g | 10.0 g |
| Benzyl alcohol | 9.0 g | 10.0 g |
| Monoethanolamine | 2.5 g | 2.5 g |
| Sodium bromide | 2.3 g | 1.5 g |
| Sodium chloride | 5.5 g | 4.0 g |
| N,N-Diethylhydroxylamine | 5.9 g | 6.5 g |
| 3-Methyl-4-amino-N-ethyl-N-(β-methanesulfonamido-ethyl)aniline sulfate | 2.7 g | 3.0 g |
| 3-Methyl-4-amino-N-ethyl-N-(β-hydroxyethyl)aniline sulfate | 4.5 g | 5.0 g |
| Potassium carbonate | 30.0 g | 35.0 g |
| Fluorescent brightening agent (stilbene type) | 1.0 g | 1.2 g |
| Pure water to make | 1,000 ml | 1,000 ml |
| pH | 10.30 | 10.70 |

The pH was adjusted using potassium hydroxide or hydrochloric acid.

| Bleach-Fixing Solution: | (both Tank and Replenisher) |
|---|---|
| Ammonium thiosulfate | 110.0 g |
| Sodium hydrogensulfite | 12.0 g |
| Ammonium iron (III) diethylenetriamine-pentaacetate | 80.0 g |
| Diethylenetriamine-pentaacetic acid | 5.0 g |
| 2-Mercapto-5-amino-1,3,4-thiadiazole | 0.3 g |
| Pure water to make | 1,000 ml |
| pH | 6.80 |

The pH was adjusted using aqueous ammonium or hydrochloric acid.

| Stabilizing Solution: | (both Tank and Replenisher) |
|---|---|
| 1-Hydroxyethylidene-1,1-diphosphonic acid | 2.7 g |
| o-Phenylphenol | 0.2 g |
| Potassium chloride | 2.5 g |
| Bismuth chloride | 1.0 g |
| Zinc chloride | 0.25 g |
| Sodium sulfite | 0.3 g |
| Ammonium sulfate | 4.5 g |
| Fluorescent brightening agent (stilbene type) | 0.5 g |
| Pure water to make | 1,000 ml |
| pH | 7.2 |

The pH was adjusted using potassium hydroxide or hydrochloric acid.

EXAMPLE 4

The same procedure as described in Example 1 was repeated except for adding Sensitizing Dye 55 according to the present invention to each emulsion layer (i.e., the third, fourth, sixth, seventh, eleventh and twelfth layers) in an amount of $1.0\times10^{-5}$ mol per mol silver. The results with respect to density of magenta color image are shown in Table 3 below. Further, almost the same results were obtained with respect to cyan and yellow color image densities.

TABLE 3

| Sample No. | Sensitizing Dye | Ninth Layer | $D_{max}$ | $D_{min}$ | Relative Sensitivity or Re-reversal Negative Image |
|---|---|---|---|---|---|
| 1 | 55* | present | 2.4 | 0.11 | 5 |
| 2 | " | none | 2.2 | 0.11 | 10 |
| 3 | — | present | 2.1 | 0.15 | 80 |
| 4 | — | none | 1.8 | 0.14 | 100 (standard) |

*Added in 3rd, 4th, 6th, 7th, 11th and 12th layers

As is apparent from the results shown in Table 3, Sample No. 1 containing the sensitizing dye and the colloidal silver containing layer according to the present invention is preferred in view of high $D_{max}$, low $D_{min}$, and low senSitivity of re-reversal negative image in comparison with Sample Nos. 2 to 4 for comparison.

EXAMPLE 5

The same procedure as described in Example 4 was repeated except for using Sensitizing Dyes 54, 20, 24 and 16 according to the present invention, respectively. The results with respect to density of cyan color image are shown in Table 4 below. Further, almost the same results were obtained with respect to magenta and yellow color image densities.

TABLE 4

| Sample No. | Sensitizing Dye | Ninth Layer | $D_{max}$ | $D_{min}$ | Relative Sensitivity of Re-reversal Negative Image |
|---|---|---|---|---|---|
| 1 | 54* | present | 2.4 | 0.12 | 5 |
| 2 | 20 | " | 2.4 | 0.12 | 5 |
| 3 | 24 | " | 2.5 | 0.12 | 4 |
| 4 | 16 | " | 2.4 | 0.12 | 5 |
| 5 | 54 | none | 2.1 | 0.12 | 10 |
| 6 | 20 | " | 2.1 | 0.12 | 10 |
| 7 | 24 | " | 2.0 | 0.12 | 8 |
| 8 | 16 | " | 2.1 | 0.12 | 10 |
| 9 | — | " | 1.7 | 0.16 | 100 (standard) |
| 10 | — | present | 1.9 | 0.18 | 90 |

*Amount in 3rd, 4th, 6th, 7th, 11th and 12th layer.

As is apparent from the results shown in Table 4, Sample Nos. 1 to 4 containing the sensitizing dye and the colloidal silver containing layer according to the present invention are preferred in view of high $D_{max}$, low $D_{min}$, and low sensitivity in comparison with Sample Nos. to 10 for comparison.

EXAMPLE 6

Light-Sensitive Materials No. 1 to No. 4 were prepared in the same manner as described in Example 1 except for using Emulsion EM-2 and an emulsion whose grain size was adjusted by decreasing the temperature at the formation of the silver halide grain. These samples were stored under conditions of 45° C. and 80%RH for 3 days (incubation test) and then subjected to Processing Method C. The results are shown in Table 5 below.

TABLE 5

| Sample No. | Sensitizing Dye*[1] | Ninth Layer | $D_{min}$ Before Incubation | $D_{min}$ After Incubation |
|---|---|---|---|---|
| 1 | 55 | present | 0.10 | 0.11 |
| 2 | 20 | " | 0.10 | 0.11 |
| 3 | — | " | 0.13 | 0.18 |
| 4 | — | none | 0.10 | 0.11 |

*[1]Amount added: $3.6\times10^{-4}$ mol/mol silver

As is apparent from the results shown in Table 2, Sample No. 3 having a colloidal silver containing layer exhibits higher $D_{min}$ and more increase in $D_{min}$ upon the incubation test as compared with Sample No. 4 which does not have the colloidal silver containing layer. Samples No. 1 and No. 2 in which the sensitizing dye and the colloidal silver containing layer are employed in combination according to the present invention exhibit preferably low $D_{min}$ both before and after the incubation test, the same as Sample No. 4. Further, Sample No. 1 and No. 2 according to the present invention are preferred since they have high blue, magenta and cyan color densities relative to gray in comparison with Sample No. 4, and they exhibit good color reproducibility.

According to the present method of forming a direct positive color image, an image having a high maximum color density, a low minimum density and a low re-reversal negative sensitivity is obtained. Further, these effects are also significantly achieved when the photographic light-sensitive material is preserved under conditions of high temperature and high humidity. Thus, the method of the present invention has far-reaching practical applications.

While the invention has been described in detail and with reference to specific embodiments thereof, it will be apparent to one skilled in the art that various changes and modifications can be made therein without departing from the spirit and scope thereof.

What is claimed is:

1. A direct positive color image forming method which comprises processing an imagewise exposed photographic light-sensitive material with a surface color developing solution containing an aromatic primary amine color developing agent, after fogging treatment and/or during fogging treatment, wherein the photographic light-sensitive material comprises a support having thereon at least one internal latent image type silver halide emulsion layer than has not been previously fogged, a color image forming coupler, colloidal silver, and at least one compound represented by general formula (I):

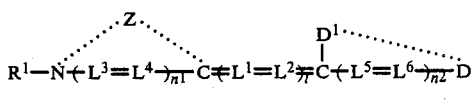

(I)

wherein Z represents an atomic group necessary for completing a 5-membered or 6-membered nitrogen-containing heterocyclic ring; D and D′, which may be the same or different, each individually represents an atomic group necessary for completing an acidic nucleus, D and D′ are be bonded to each other to form a cyclic structure, and wherein the nucleus formed by D and D′ is selected from 2-pyrazolin-5-one, pyrazolidine-3,5-dione, imidazolin-5-one, hydantoin, 2- or 4-thiohydantoin, 2-iminooxazolin-4-one, 2-oxazolin-5-one, 2-thiooxazolindine-2,4-dione, isooxazolin-5-one, 2-thiazoline-4-one, thiazolidine-4-one, thiazolidine-2,4-dione, rhodanine, thiazolidine-2,4-dithione, isorhodanine, indane-1,3-dione, thiophen-3-one, thiophen-3-one-1,1-dioxide, isoindolin-2-one, isoindilin-3-one, indazolin-3-one, 2-oxoindazolinium, 3-oxoindazolium, 5,7-dioxo-6,7-dihydrothiazolo[3,2-a]pyrimidine, cyclohexane-1,3-dione, 3-4-dihydroisoquinolin-4-one, 1,3-dioxane-4,6-dione, barbituric acid, 2-thiobarbituric acid, chroman-2-4-dione, indazolin-2-one, and pyrido[1,2-a]pyrimidine-1,3-dione; $R^1$ represents a substituted or unsubstituted alkyl group which may form a salt with a metal atom or an organic compound; $L^1$, $L^2$, $L^3$, $L^4$, $L^5$ and $L^6$, which may be the same or different, each represents a substituted or unsubstituted methine group; $n^1$ and $n^2$ each represents 0 or 1; and l represents an integer from 0 to 3.

2. A direct positive color image forming method as claimed in claim 1, wherein the atomic groups forming the heterocyclic ring represented by Z is selected from a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a selenazoline nucleus, a tetrazole nucleus, a benzotetrazole nucleus, a naphthotetrazole nucleus, a tetrazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5-b]quinoxaline nucleus, an oxadiazole nucleus, a thiadiazole nucleus and a pyrimidine nucleus.

3. A direct positive color image forming method as claimed in claim 1, wherein said $R^1$ is a substituted alkyl group having up to 18 carbon atoms, and having a substituent selected from a carboxy group, a sulfo group, a cyano group, an amino group, a halogen atom, a hydroxy group, an alkoxycarbonyl group having up to 8 carbon atoms, an alkoxy group having up to 8 carbon atoms, a monocyclic aryloxy group having up to 10 carbon atoms, an acyloxy group having up to 3 carbon atoms, an acyl group having up to 8 carbon atoms, a carbamoyl group, a sulfamoyl group and an aryl group having up to 10 carbon atoms.

4. A direct positive color image forming method as claimed in claim 1, wherein $R^1$ represents an alkyl group substituted with an amino group or an unsubstituted alkyl group.

5. A direct positive color image forming method as claimed in claim 1, wherein the substituent for the methine group represented by $L^1$, $L^2$, $L^3$, $L^4$, $L^5$ or $L^6$ is selected from a substituted or unsubstituted alkyl group, a substituted or unsubstituted aryl group and a halogen atom.

6. A direct positive color image forming method as claimed in claim 1, wherein the compound represented by general formula (I) is present in the internal latent image type silver halide emulsion layer.

7. A direct positive color image forming method as claimed in claim 6, wherein the compound represented general formula (I) is present in an amount of from $1\times10^{-6}$ to $1\times10^{-2}$ mol per mol of silver.

8. A direct positive color image forming method as claimed in claim 1, wherein the colloidal silver is present in a layer adjacent to the internal latent image type silver halide emulsion layer.

9. A direct positive color image forming method as claimed in claim 1, wherein said photographic light-sensitive material comprises at least two layers containing colloidal silver.

10. A direct positive color image forming method as claimed in claim 9, wherein at least one of the layers containing colloidal silver is a yellow filter layer provided below a blue-sensitive layer.

11. A direct positive color image forming method as claimed in claim 1, wherein the internal latent image type silver halide emulsion is a monodispersed silver halide emulsion.

12. A direct positive color image forming method as claimed in claim 1, wherein the internal latent image type silver halide emulsion is a conversion type silver halide emulsion or core/shell type silver halide emulsion.

13. A direct positive color image forming method as claimed in claim 1, wherein the photographic light-sensitive material comprises at least one red-sensitive photographic emulsion layer containing internal latent image type silver halide grains and a cyan color image forming coupler, at least one green-sensitive photographic emulsion layer containing internal latent image type silver halide grains and a magenta color image forming coupler, and at least one blue-sensitive photographic emulsion layer containing internal latent image type silver halide grains and a yellow color image forming coupler.

14. A direct positive color image forming method as claimed in claim 13, wherein the magenta coupler is represented by general formula (II):

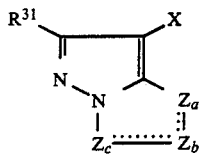

(II)

wherein $R^{31}$ represents a hydrogen atom or a substituent; X represents a hydrogen atom or a group capable of being released upon a coupling reaction with an oxidation product of an aromatic primary amine developing agent; $Z_a$, $Z_b$, and $Z_c$, which may be the same or different, each represents a methine group, a substituted methine group, =N— or —NH—, provided that one of $Z_a$–$Z_b$ bond and $Z_b$–$Z_c$ bond is a double bond and the other is a single bond; when $Z_b$–$Z_c$ is a carbon-carbon double bond, $Z_b$–$Z_c$ may be a part of a condensed aromatic ring; when $R^{31}$ or X is a divalent group, the compound of general formula (II) may form a polymer including a dimer or higher polymer; when $Z_a$, $Z_b$ or $Z_c$ is a substituted methine group, the compound of general formula (II) may form a polymer including a dimer or higher polymer.

15. A direct positive color image forming method as claimed in claim 13, wherein the yellow coupler is an α-pivaloylacetanilide type coupler or an α-benzoylacetanilide type coupler.

16. A direct positive color image forming method as claimed in claim 13, wherein the cyan coupler is a naphtholic coupler or a phenolic coupler.

* * * * *